US012173448B2

(12) United States Patent
Heidenreich et al.

(10) Patent No.: US 12,173,448 B2
(45) Date of Patent: Dec. 24, 2024

(54) HYBRID STEAMER IRON ASSEMBLY

(71) Applicant: Spectrum Brands, Inc., Middleton, WI (US)

(72) Inventors: Drew W. Heidenreich, Monona, WI (US); Rachel B. Koebler, Madison, WI (US); Kroy E. Nernberger, Madison, WI (US); Boopalan Sampath, Madison, WI (US); Daniel R. Strong, Madison, WI (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 18/023,930

(22) PCT Filed: Sep. 7, 2021

(86) PCT No.: PCT/US2021/049227
§ 371 (c)(1),
(2) Date: Feb. 28, 2023

(87) PCT Pub. No.: WO2022/055844
PCT Pub. Date: Mar. 17, 2022

(65) Prior Publication Data

US 2023/0313443 A1 Oct. 5, 2023

Related U.S. Application Data

(60) Provisional application No. 63/075,489, filed on Sep. 8, 2020.

(51) Int. Cl.

| | |
|---|---|
| ***D06F 75/18*** | (2006.01) |
| ***D06F 75/20*** | (2006.01) |
| ***D06F 75/38*** | (2006.01) |

(52) U.S. Cl.
CPC ..... *D06F 75/18* (2013.01); *D06F 75/20* (2013.01); *D06F 75/38* (2013.01)

(58) Field of Classification Search
CPC ..... D06F 75/18; D06F 75/20; D06F 75/38
See application file for complete search history.

(56) References Cited

U.S. PATENT DOCUMENTS 2,065,366 A * 12/1936 Eichorn ..... D06F 75/38 219/254
2,343,555 A * 3/1944 Huffman ..... D06F 75/16 38/92

(Continued)

FOREIGN PATENT DOCUMENTS

| | | | |
|---|---|---|---|
| CN | 109957956 | A | 7/2019 |
| JP | 2020168553 | A * | 10/2020 |
| KR | 100126112 | B1 | 12/1997 |

OTHER PUBLICATIONS

International Search Report for co-pending PCT/US2021/049227, 7 pages, Sep. 7, 2021.

(Continued)

*Primary Examiner* — Ismael Izaguirre
(74) *Attorney, Agent, or Firm* — Kagan Binder, PLLC

(57) ABSTRACT

Methods and features described herein are applicable to an improved hand-hand steaming iron that reduces dripping while operating in various orientations and that improves consistent steam generation. The iron includes a steam generating chamber that includes an integrated resistive heating element, and the chamber utilizes multiple dividing and fluid guiding elements with back and forth turn features to prevent liquid water from escaping the steam generating chamber in both vertical and horizontal positions. The combination of the geometric walls and the interaction with (Continued)

the heating element allow for a consistent soleplate temperature and efficient steaming of water that enters the chamber.

11 Claims, 21 Drawing Sheets

(56) References Cited

U.S. PATENT DOCUMENTS

| | | | | |
|---|---|---|---|---|
| 3,110,975 | A * | 11/1963 | Kircher | D06F 75/18 38/77.7 |
| 4,747,222 | A | 5/1988 | Riba | |
| 5,388,180 | A * | 2/1995 | Bayles | F22B 1/288 392/484 |
| 6,986,217 | B2 * | 1/2006 | Leung | D06F 73/00 68/222 |
| 7,673,405 | B2 * | 3/2010 | Guohong | D06F 75/24 38/77.83 |
| 2010/0257761 | A1 | 10/2010 | Choi | |
| 2010/0299975 | A1 | 12/2010 | Thomas | |
| 2017/0016174 | A1 * | 1/2017 | Rosa | D06F 75/20 |

OTHER PUBLICATIONS

GB Further Examination Report for copending GB2303246.9, 5 pages, May 10, 2024.
EP Supplementary Search Report for copending EP21867420.8, 11 pages, Aug. 13, 2024.

* cited by examiner

HYBRID STEAMER IRON ASSEMBLY

PRIORITY CLAIM

This application claims priority to International Application No. PCT/US2021/049227, filed on Sep. 7, 2021, which in turn claims the benefit of U.S. Provisional Patent Application No. 63/075,489, Sep. 8, 2020, the entire contents of which are incorporated herein by reference in their entireties.

BACKGROUND

Aspects of this disclosure are directed to irons, and in particular to hand-held irons with improved built-in steaming.

Wrinkles in fabric are widely considered to be undesirable, but inevitable. Ironing has long existed as a way to reduce or remove wrinkles or creases in fabric. In earlier times, irons (also called flatirons, sadirons, or box irons, among others) were very simple devices, having a soleplate being a flat piece of metal that was contacted to an external heating element, removed from the heating element, and applied to the fabric, such as clothes or linens. The iron was then applied in a back-and-forth motion over the surface of the fabric until the iron cooled down due to ambient temperature, at which point the soleplate of the iron could be reheated or exchanged for another heated iron. Other types of irons employed hollow metal boxes containing various heating material, such as charcoal, in order to stay sufficiently hot. Early irons were very heavy due to the large amount of metal and/or heat source. Ironing with early irons generally took many passes and could be tiring and inefficient, especially over extended periods of time.

Later, self-heating electric irons were introduced, and could be used nearly continuously without stopping to reheat, refuel, or swap out the iron. The use of plastics and other lightweight materials in irons also increased, leading to reduced iron weight. Electric irons generally were heated using a resistive element located within or near a metal soleplate, which was usually made of aluminum or stainless steel.

Incremental improvements over the years, such as the introduction of water and steam injection components, led to a more effective and versatile iron. A typical modern iron includes a water reservoir and capacity to heat liquid water into steam and introduce the produced steam to fabric through holes located in the soleplate, causing fabric molecule bonds to loosen and to stretch under the weight, heat, and/or motion of the iron, leading to flatter, more uniformly pressed fabric. The fabric would then cool and typically stay pressed for a period of time. A typical iron heats a metal soleplate to roughly 180-220° Celsius (about 350-430° Fahrenheit), but may be hotter or cooler depending on the fabric to be ironed and the type and configuration of iron being used. It can be desirable to have controlled soleplate temperature such that fabrics are heated sufficiently for pressing, but below a temperature at which the fabric burns, melts, or is otherwise damaged or discolored.

Typically, an iron assembly is composed of various components, including a main body housing, an electrical cord and wall plug, a soleplate, a handle, a stand feature to keep a hot soleplate off fabric when not in use, a water reservoir, a steam or boiler system, and a thermostat, among other features. The heated soleplate is typically the aspect of an iron that intentionally contacts any fabric being ironed, and thus the soleplate, and the heating thereof, is an important component of an iron.

The geometry of an iron soleplate is typically configured in a generally flat, roughly triangular lobed shape with a front tip and a rear base, and often has multiple holes formed in it for the passage of steam from a heated reservoir to the fabric being ironed. Generally, iron soleplates have a top and bottom surface that are substantially planar, with respect to the ironing surface of the soleplate that contacts the fabric, the bottom surface providing a nearly uniform pressure on all contact points of the soleplate to the fabric. Soleplates have thermal mass and can store thermal energy during periods when power is not being applied to the soleplate.

Existing steaming irons are typically either designed as horizontally-operated hand irons for use on a horizontal ironing board surface, or are hand-held steamer units for use in generally vertical orientations, such as on hanging clothes and the like. Therefore, existing irons and hand-held steamers have typically been configured for either horizontal or vertical use, and they have lacked the ability to effectively produce steam (and not leak water) with a fabric both in the vertical and horizontal positions while also having a soleplate large enough to practically iron the fabric. Therefore there is a desire to produce an improved hand-hand steamer and iron hybrid unit that reduces dripping while operating in various orientations.

SUMMARY

The methods and features described herein are applicable to an improved hand-hand steaming iron that reduces dripping while operating in various orientations. The iron includes a steam generating chamber that includes an integrated resistive heating element, and the chamber utilizes multiple dividing and fluid guiding elements with back and forth turn features to prevent liquid water from escaping the steam generating chamber in both vertical and horizontal positions. The combination of the geometric walls and the interaction with the heating element allow for a consistent soleplate temperature and efficient steaming of water that enters the chamber.

Inside of the steam generating chamber, the walls are curved upwards (toward the tip of the soleplate) to create pockets of liquid water that will be substantially converted to steam before leaving the chamber, including when in the horizontal position. In the vertical position, the steam exit openings are raised up (toward the tip) to produce a similar effect utilizing the entire steaming surface as the liquid water pocket. The chamber is contained within and defined at least in part by a soleplate assembly that includes at least an inner soleplate and an outer soleplate that is either separate from and connected to the inner soleplate or an exposed portion of the inner soleplate.

These and various other features and advantages will be apparent from a reading of the following detailed description.

BRIEF DESCRIPTION OF THE DRAWINGS

The present invention will be further explained with reference to the appended Figures, wherein like structure is referred to by like numerals throughout the several views, and wherein.

DETAILED DESCRIPTION

The present invention overcomes shortcomings of the prior art by introducing an improved iron with built-in steaming.

Figure 5:
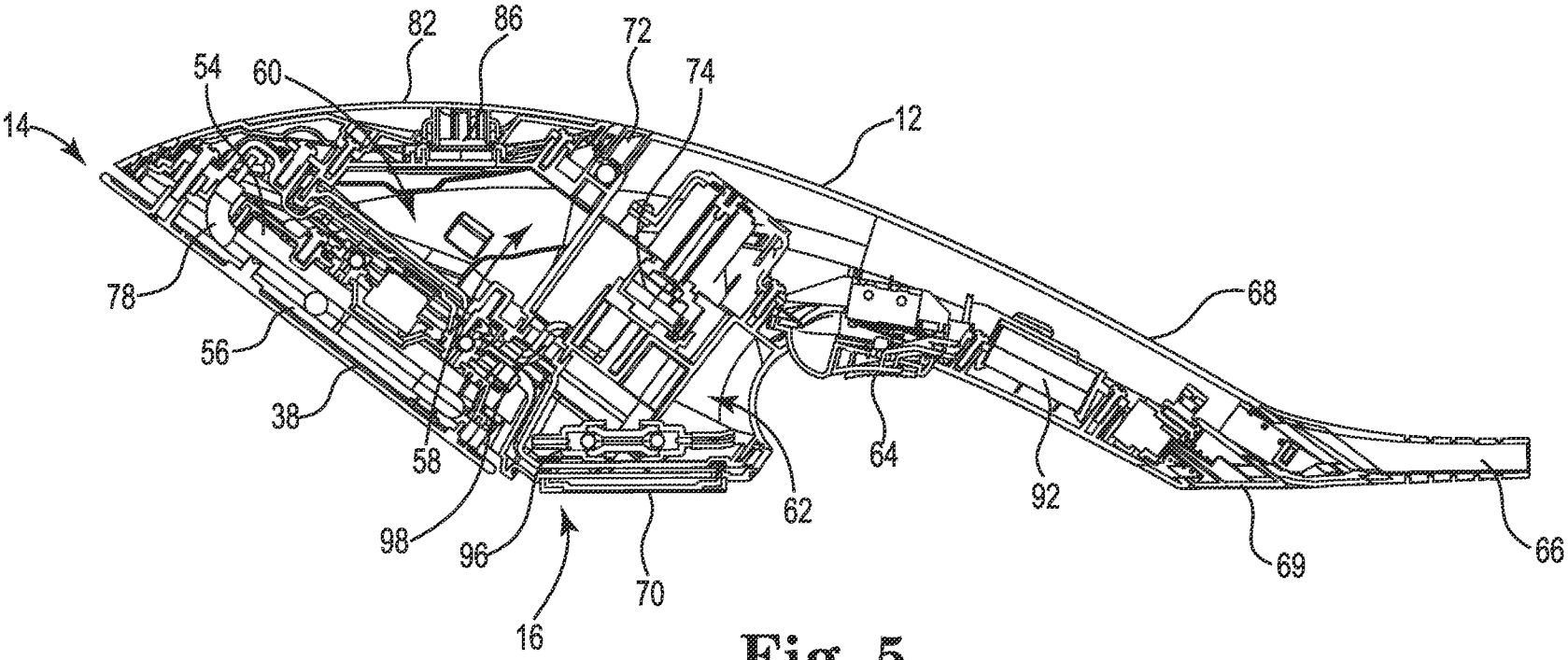
FIG. 5 is a side cross-sectional view of the iron of FIG. 1 in the resting position, according to various embodiments.

As shown with reference in particular to FIGS. 1-5, a hybrid hand-held steam iron 10 according to the present disclosure is shown. The iron 10 comprises a housing 12 connected to a soleplate assembly 18. The housing 12 includes a handle portion 68 for manipulation of the iron 10 by a user, and a power cord 66 (shown partially removed for clarity) that extends from housing 12 for providing electrical power to the iron 10. As shown best in FIG. 3, the iron 10 comprises a trigger 64 positioned along the handle portion 68 of the housing 12 for activating a pump 74 that is operatively supported in the housing 12 such as shown in FIG. 5. For example, the trigger 64 can be provided for user manipulation at an external position of the housing 12. The housing 12 also supports a thermostat 100 for monitoring temperatures of the soleplate assembly 18. The pump 74 provides controlled water flow to the soleplate assembly 18. A rest plate 70 angled to an outer soleplate 38 is preferably provided for safely setting the iron 10 on a flat surface when not in use.

Figure 8:
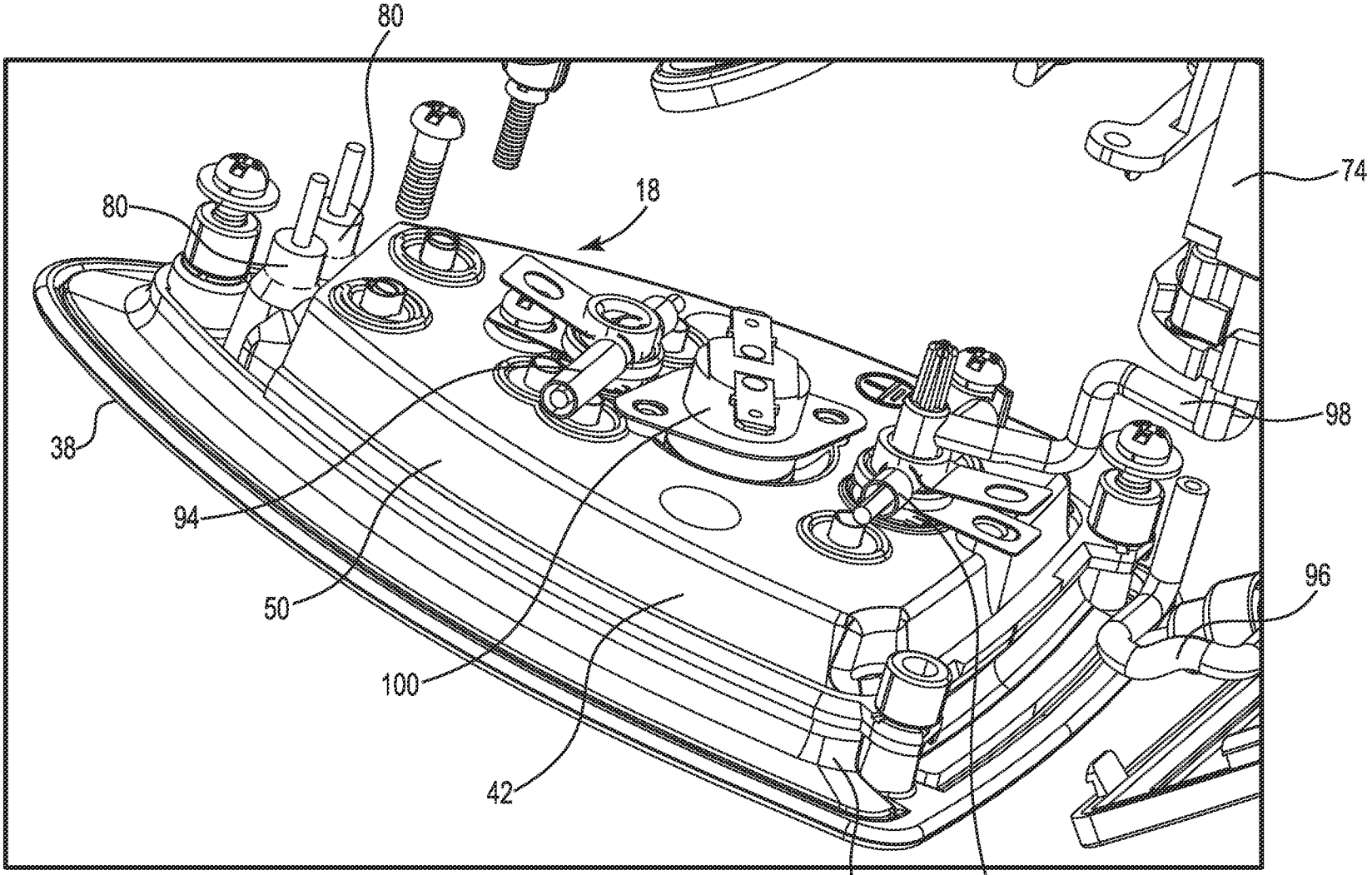
FIG. 8 is yet another perspective view of selected operative components of the iron of FIG. 1, according to various embodiments.

With reference in particular to the cross-sectional side view of the iron 10 in FIG. 5, the housing 12 also internally comprises and supports parts of the soleplate assembly 18, the pump 74, a water reservoir 58, a controller and operative electrical and control components (not shown), and various fluidic connections. Specifically, a water intake tube 96 fluidly connects the reservoir 58 to the pump 74 at a pump intake 76 (see FIG. 8), and a water output tube 98 fluidly connects the pump 74 to the soleplate assembly 18 at opening 46 for heating the water to produce steam on demand. As shown in FIG. 5, the intake tube 96 optionally comprises and is fluidically connected to one or more valves, such as a bi-directional check valve assembly. Various operative portions of the iron 10 and in particular the soleplate assembly 18 are described in greater detail below.

Figure 1:
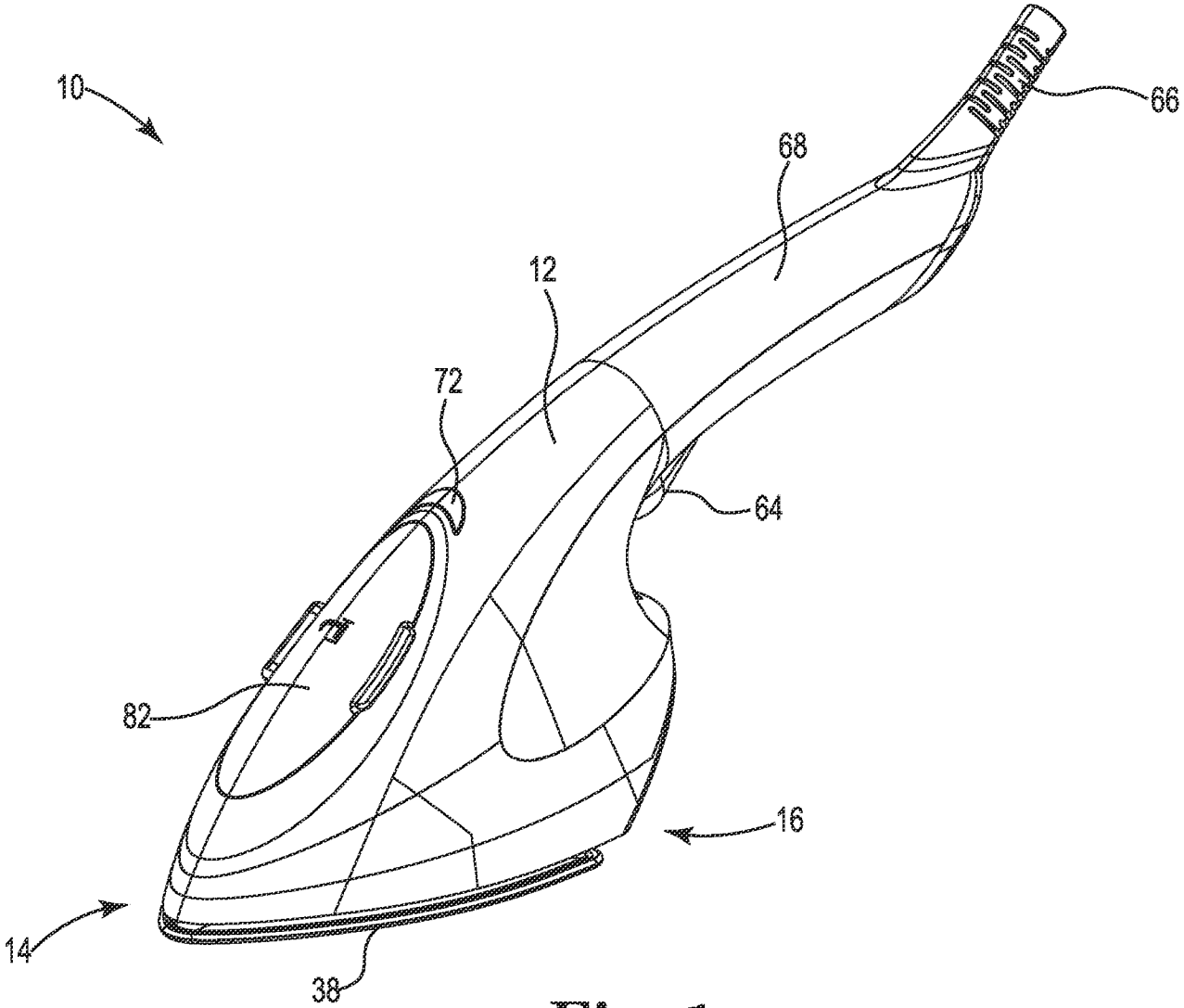
FIG. 1 is an upper perspective view of a hand-held iron in a horizontal position, according to various embodiments.
Figure 2:
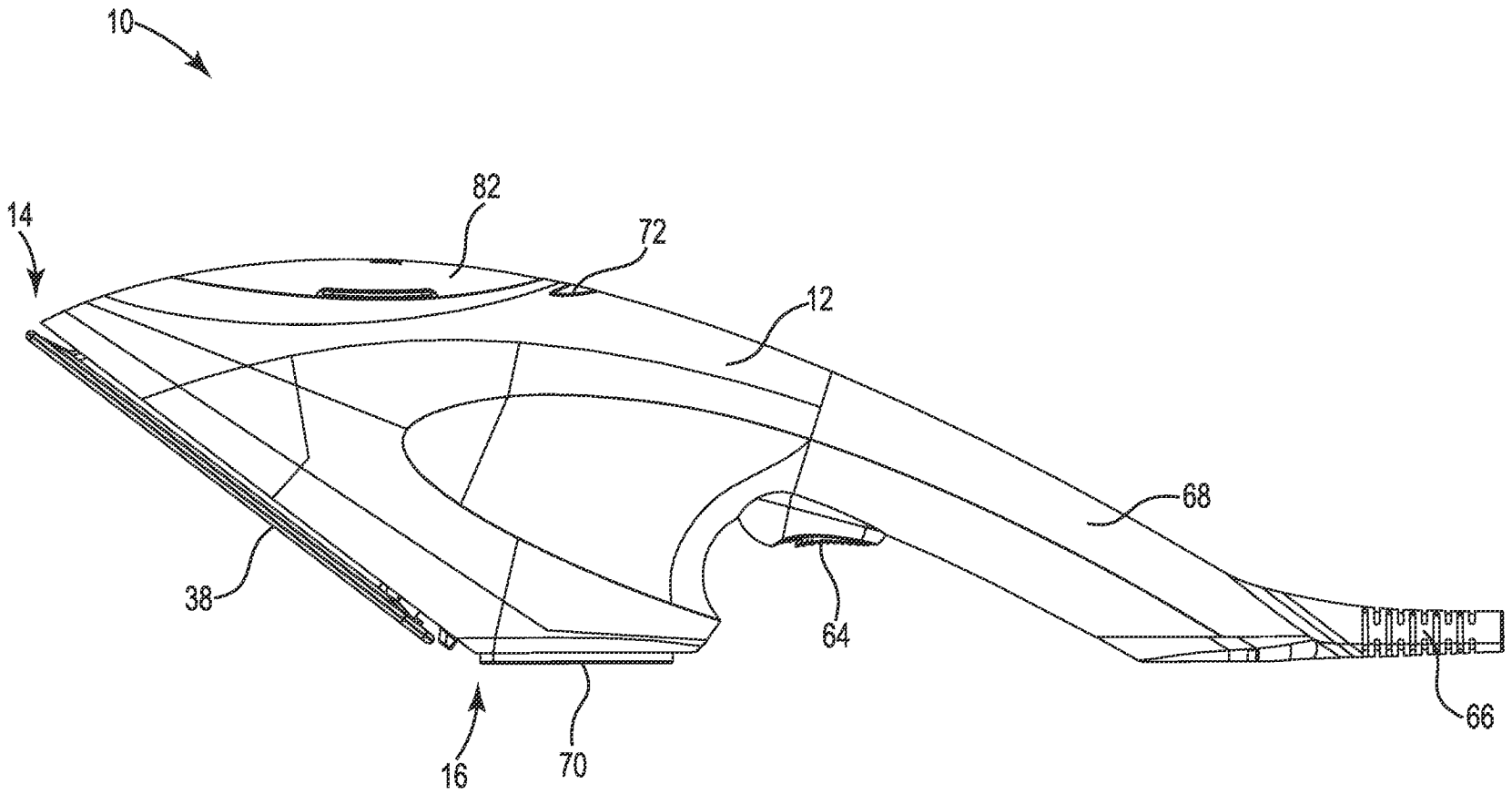
FIG. 2 is a side profile view of the hand-held iron of FIG. 1 in a resting position, according to various embodiments.

In FIG. 1, the example iron 10 is shown in the horizontal ironing position. FIG. 2 shows the iron in the tilted, rest position where the outer soleplate 38 (base) does not contact a surface to be ironed. Yet further embodiments including positioning the iron 10 in a vertical position (not shown) where the outer soleplate 38 is substantially vertical, e.g., such as would be used to steam hanging garments, fabrics, and the like. As described herein, the iron 10 can beneficially combine the functions and benefits of both traditional horizontal clothes irons and hand-held steamers into a single hybrid unit in iron 10.

Figure 3:
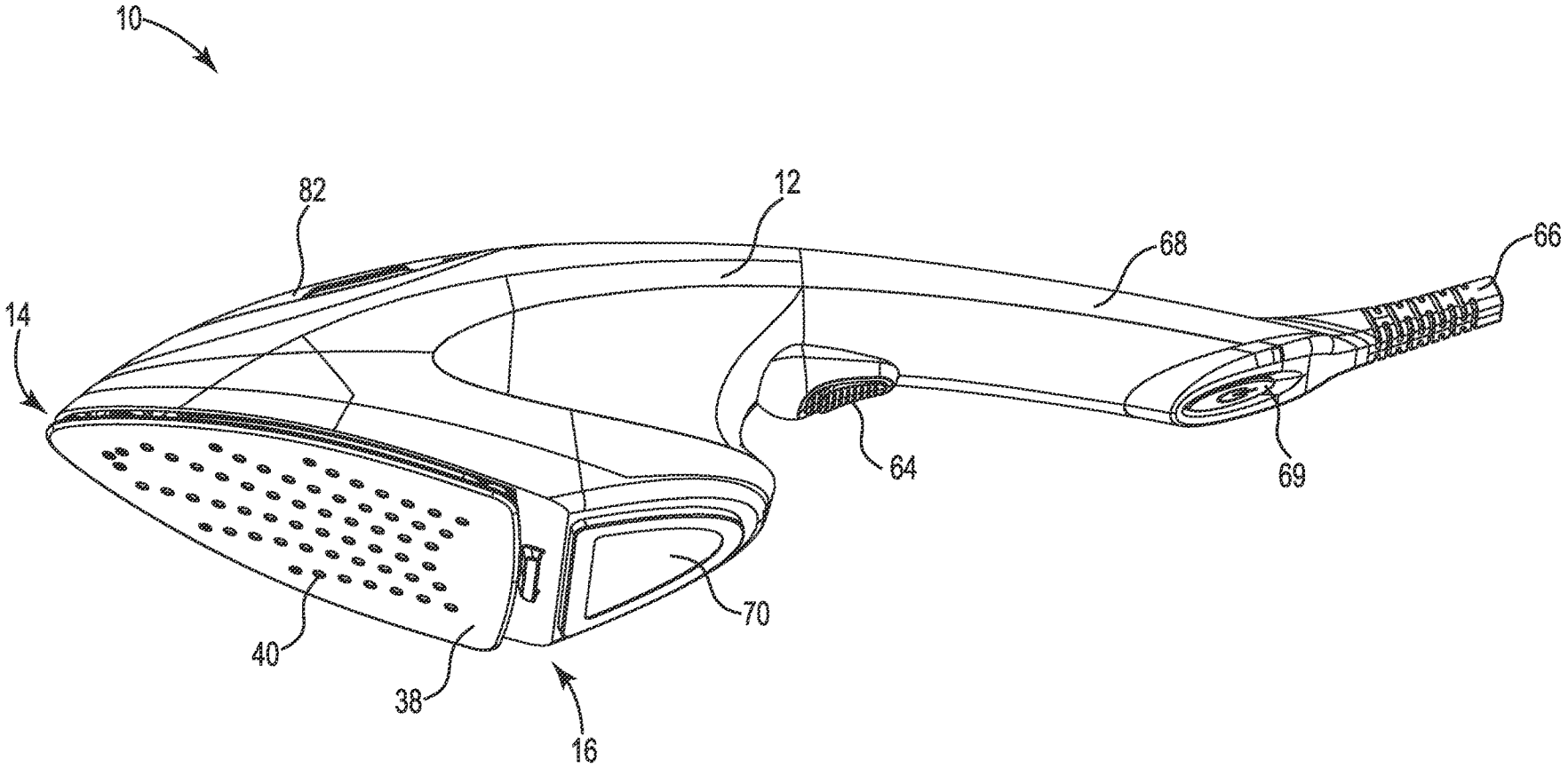
FIG. 3 is a lower perspective view of the hand-held iron of FIG. 1, according to various embodiments.
Figure 4:
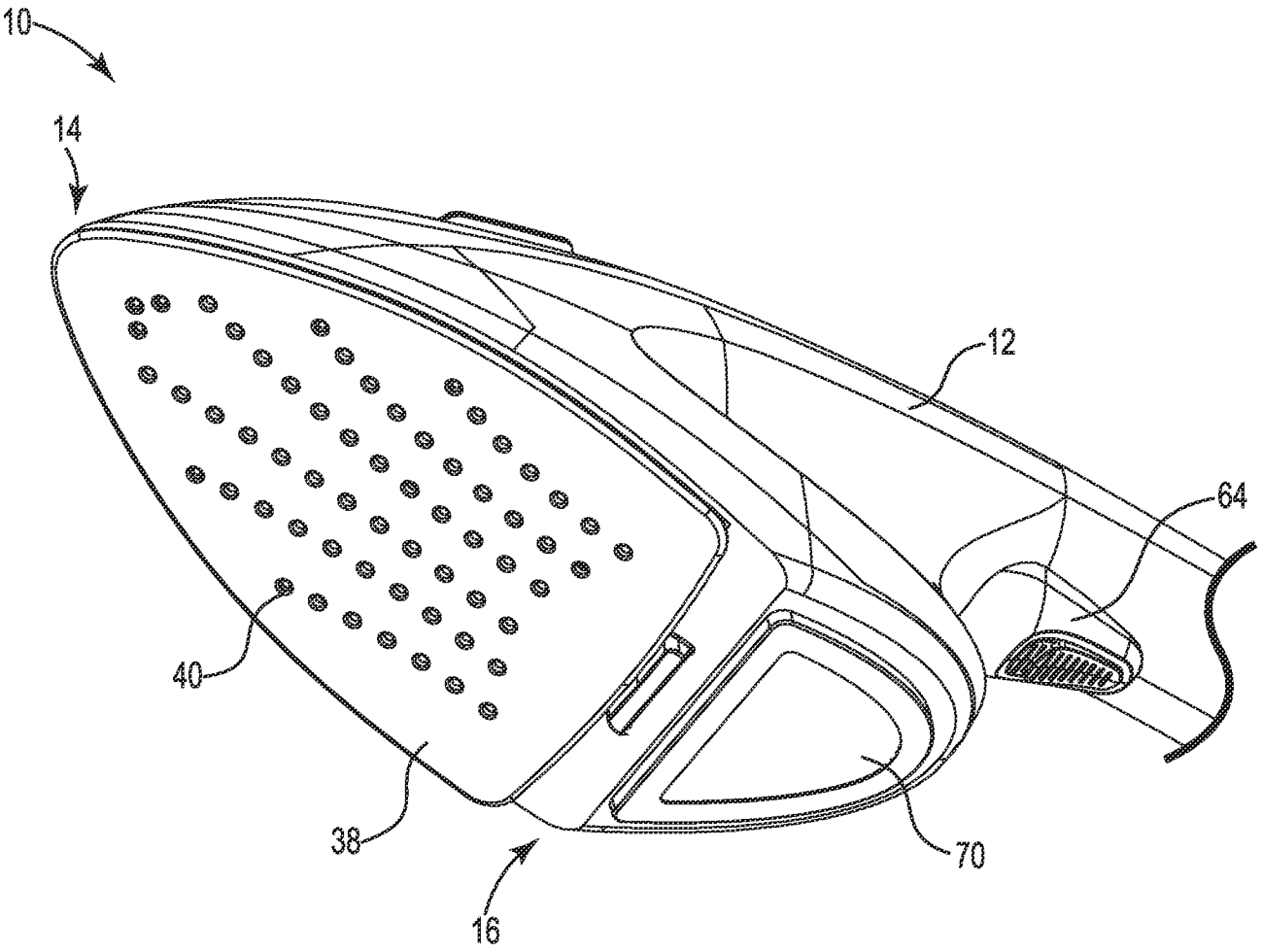
FIG. 4 is a close-up view of features on a lower side of the hand-held iron of FIG. 1, according to various embodiments.

The power cord 66 provides power to a power circuit that is connected to various electric and/or electronic components of the iron 10. As shown in FIG. 3, a power switch 69 is provided to power the iron 10 on and off. As shown, the iron 10 includes the pump 74 and a heating element 78 (as discussed below), which are both powered through power cord 66, and are also both controllably connected to the controller (not shown) that regulates temperatures of various components and/or receives user inputs, such as by trigger 64. The thermostat 100 is also operatively coupled to the power circuit and preferably the controller, heating element 78, and/or pump 74, as suitable. As shown in FIG. 5, the housing 12 of the iron 10 also optionally includes an indicator light 72 (e.g., a light emitting diode) operatively connected to the controller and power cord 66 and mounted to the housing 12. The indicator light 72, as controlled by the controller or various circuitry, can perform any suitable function as known in the art, such as indicating the iron 10 is up to temperature, the iron 10 is plugged in, the heating element 78 is on, the reservoir 58 is empty, or the like. Any number of indications and/or lights 72 can be provided. The iron 10 can comprise the power circuit (not shown) in which various components such as discussed above are in various parallel and/or series wiring arrangements.

Figure 7:
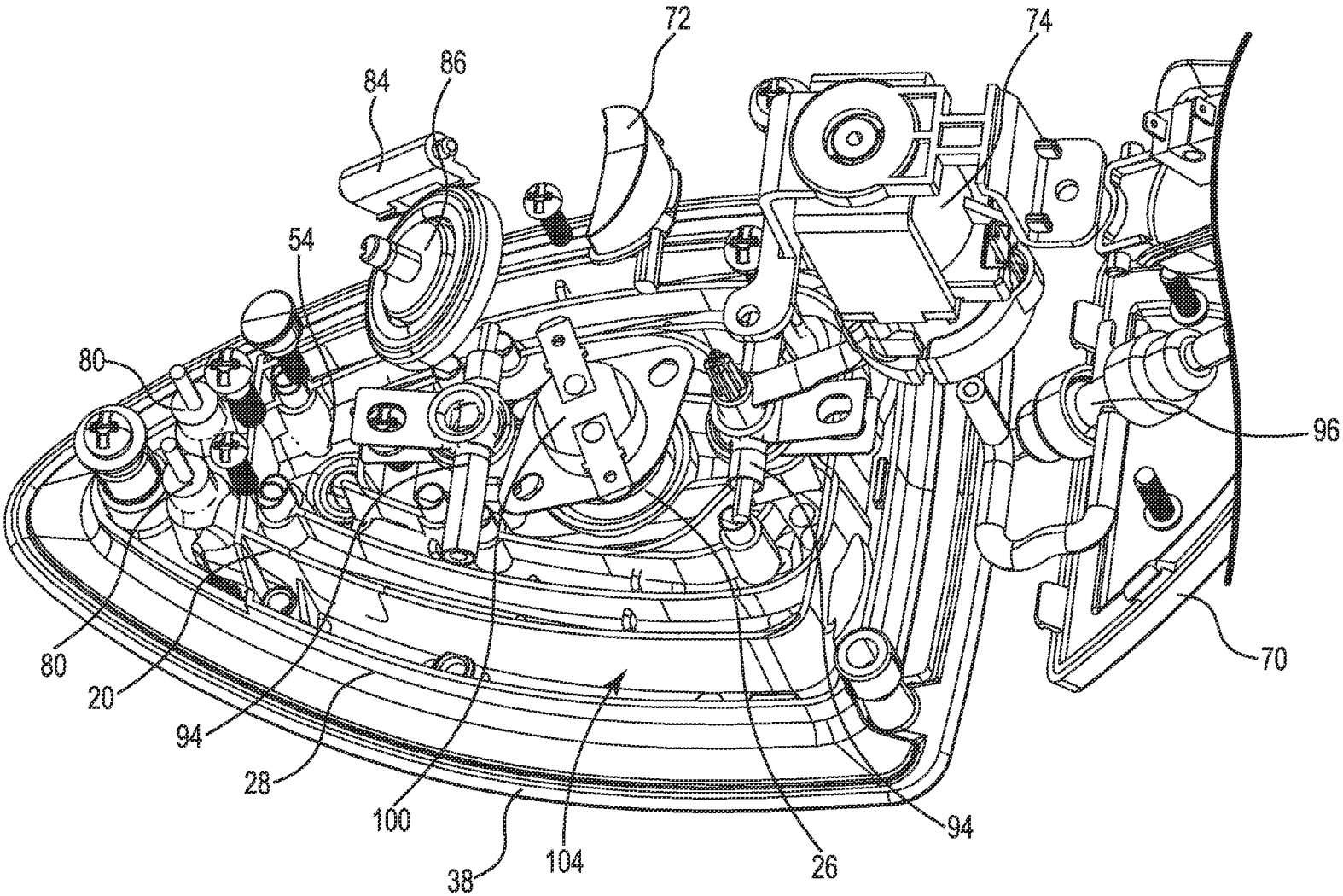
FIG. 7 is another perspective view of selected operative components of the iron of FIG. 1, according to various embodiments.
Figure 9:
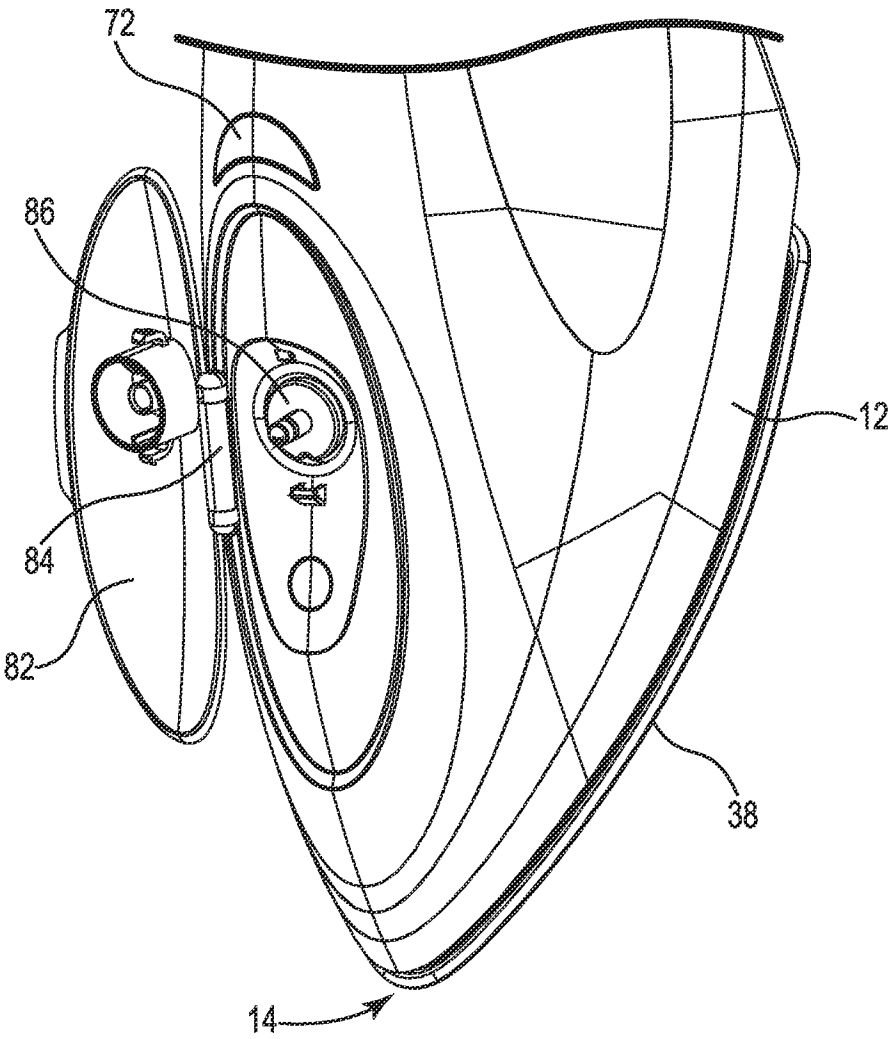
FIG. 9 is a perspective view of a fill door and fill cap on an upper portion of a housing of the iron of FIG. 1, according to various embodiments.
Figure 10:
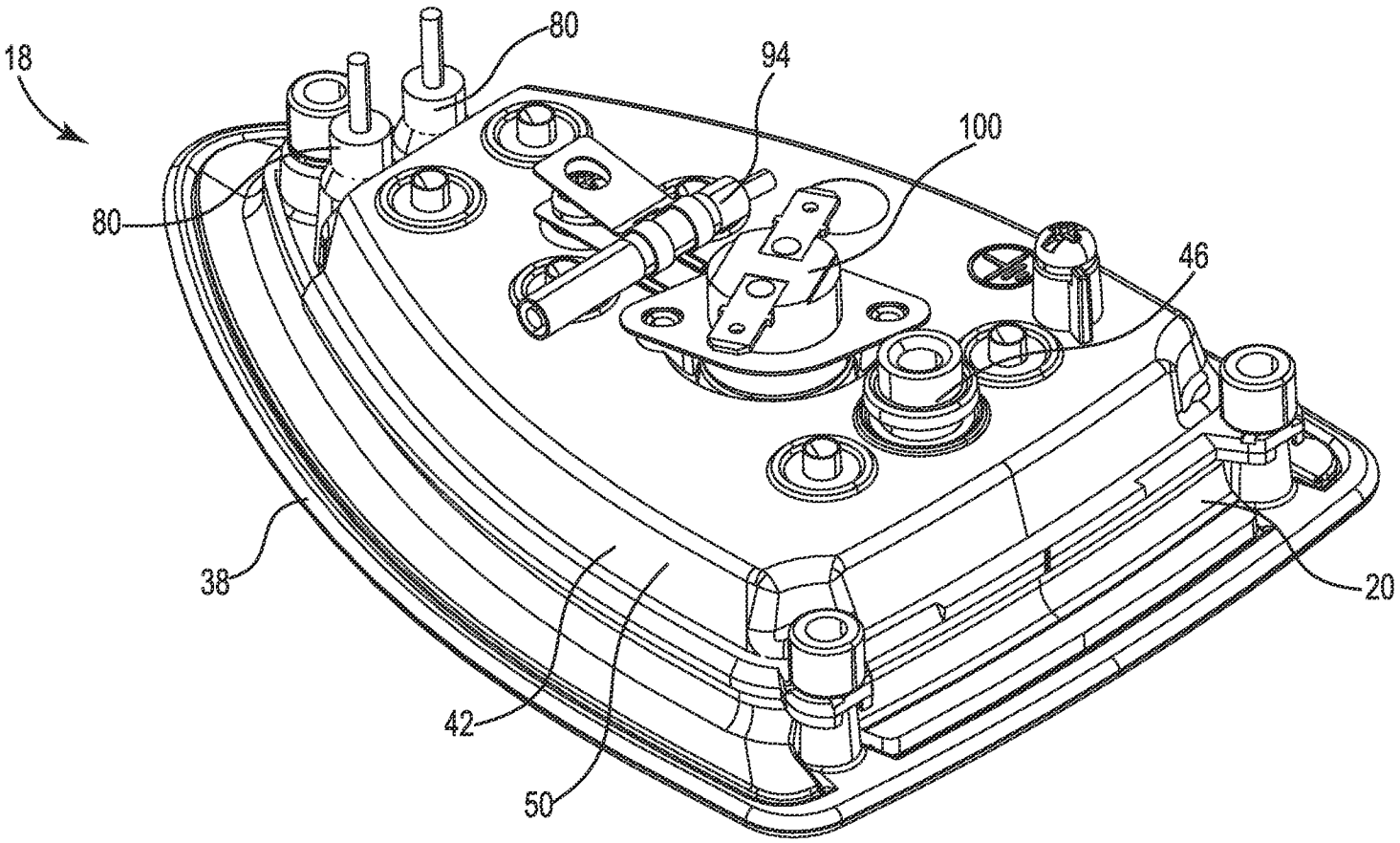
FIG. 10 is a perspective view of a soleplate assembly with various related components of the iron of FIG. 1, according to various embodiments.

With reference now in particular to FIGS. 7 and 9, the iron 10 also preferably comprises one or more electrical fuse(s) 94 to provide overheat and/or short circuit protection to the electric and/or electronic components of the iron 10, including heating element 78. For example, the fuse(s) 94 is preferably electrically connected in series with heating element 78 and/or thermostat 100 such that at a certain current or power flow, the fuse(s) 94 blow or disconnect, improving safety and overheat protection of the iron 10. Also as shown, the heating element 78 preferably has two connections 80 located near a pointed front tip portion 14 of the soleplate assembly 18.

Figure 6:
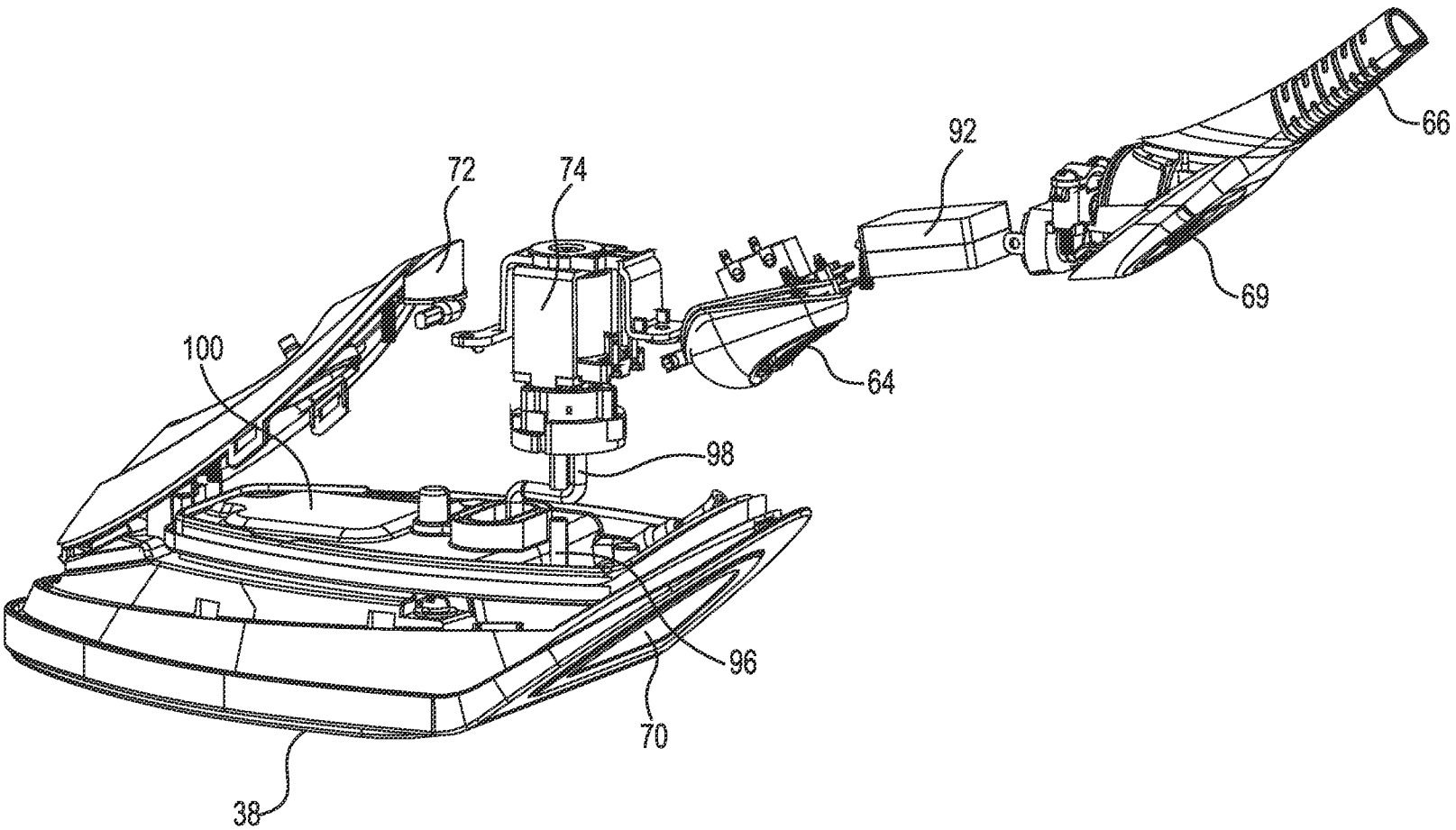
FIG. 6 is a perspective view of selected operative components of the iron of FIG. 1, according to various embodiments.

Optionally and as shown with reference to FIGS. 5 and 6 in particular, the housing 12 operatively supports a counterweight ballast 92 mounted in or near the handle portion 68 of iron 10 such that a weight of the water within the reservoir 58 is balanced so that the iron can be manipulated and positioned with improved balance. The ballast 92 can be formed of one or more metals, such as iron, lead, alloys, or the like. The reservoir 58 can be defined by the housing 12 and/or various components supported therein, and as shown comprises a reservoir rear section 62 located proximate the rest plate 70 and the rear base portion 16 and a reservoir forward section 60 located proximate the pump 74 and a fill door 82 connected to the housing 12 via hinge 84, as further described below. The configuration of the reservoir 58 and the ballast 92 can be configured to create a desirable and ergonomic balance of the iron 10 for use and positioning by a user.

With reference to FIG. 9, a fill cap 86 for accessing and filling the reservoir 58 is located behind the hinged fill door 82 (when door 82 is closed) for accessing the reservoir 58 until the door 82 is opened. Opening the door 82 as shown in FIG. 9 reveals a large accessible opening for accessing the fill cap 86. In preferable embodiments, the iron 10 can be positioned below a water faucet for easy filling of the reservoir 58 without removing the reservoir from the iron 10. The fill cap 86 can be a twist-lock, bayonet, threaded, pressure-fit, or any suitable cap for holding water within the reservoir 58. A portion of the fill cap 86 can be attached to the door 82 so as to be automatically opened with the door 82. For example and as shown in FIG. 1, the door 82 when closed is streamlined with the housing 12 and provides a seamless and smooth appearance.

With reference now in particular to FIGS. 10-19, the soleplate assembly 18 is described in detail. According to the present disclosure, the soleplate assembly 18 improves on existing soleplates by introducing multi-orientation, leak-resistant, and fast-boiling features such that water is quickly boiled when desired, but is less likely to drop or leak onto a fabric at various iron 10 orientations. The soleplate assembly 18 is configured to permit repeated 90-degree rotations between horizontal and vertical orientations without water dripping from the soleplate assembly 18.

Figure 19:
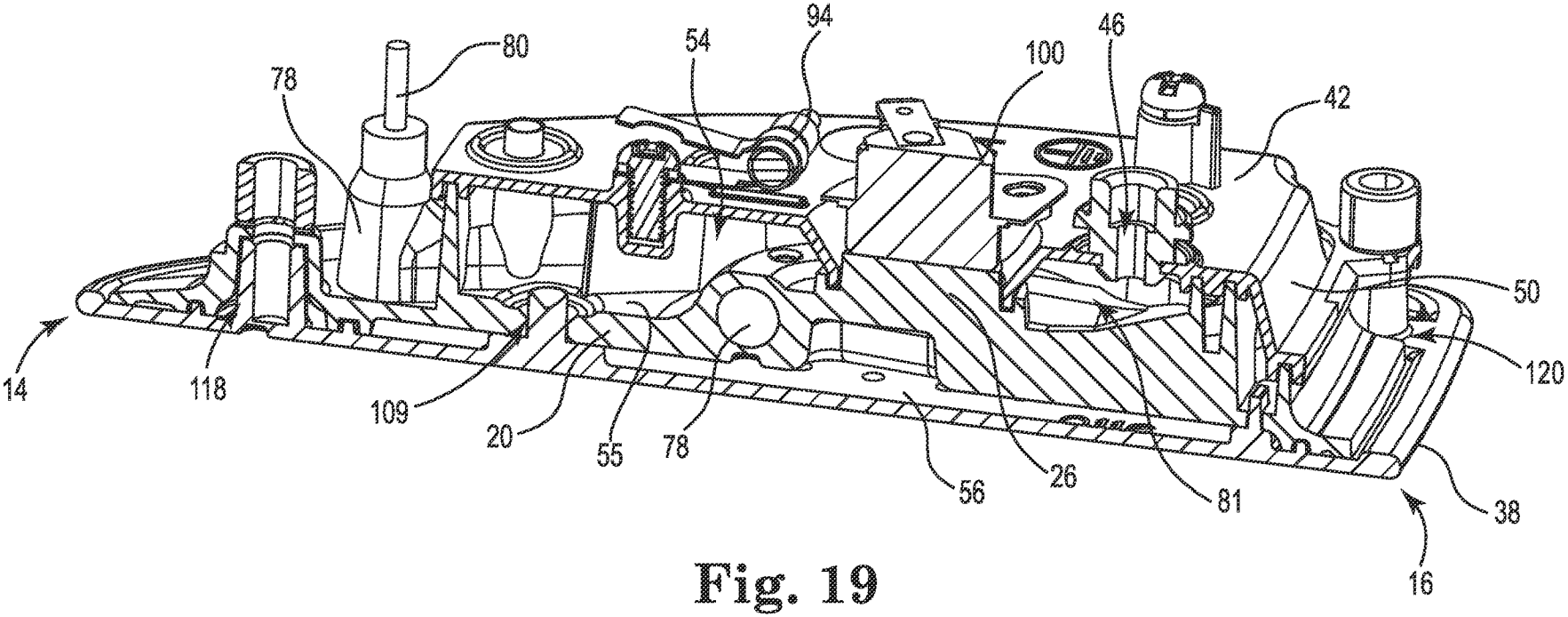
FIG. 19 is a longitudinal cross-sectional view of the inner soleplate of the soleplate assembly of FIG. 10, according to various embodiments.

The soleplate assembly 18 defines at least one fluid flow path 106 starting at an opening 46 as water is received from pump 74 and ending at steam delivery openings 40. The soleplate assembly 18 comprises an outer soleplate 38, the inner soleplate 20 having a steam generation surface 55 on an upper side thereof, and a soleplate cover 42 having walls 50 that enclose the steam generation surface 55. As shown in FIG. 19, the outer soleplate 38 is spaced from the inner soleplate 20 by a distance. In some preferable embodiments, the spacing between the inner 20 and outer soleplate 38 is substantially uniform so as to define an air gap between the soleplates.

The steam generation surface 55 of the inner soleplate 20 preferably faces up and toward the opening 46 in the cover 42, and the opposite side as the steam generation surface 55 faces the air gap and the outer soleplate 38. The steam generation surface 55 is preferably located above the heating element 78. The air gap between the two soleplates can define the steam distribution chamber 56, which is ultimately vented to fabric to be ironed by steam delivery openings 40 in outer soleplate 38. The gap is preferably created by connections structure primarily along the periphery of the inner 20 and outer soleplates 38, such as at front mounting hole 22 and/or rear mounting openings 24. However, additional intermediate structures can be provided as well. For example, a connection point is provided at a central mounting hole 23 in inner soleplate 20. The soleplate assembly 18 also preferably includes the upper soleplate cover 42, which defines and encloses a steam generation chamber 54 in combination with the steam generation surface 55 and the inner soleplate 20. The outer soleplate 38 is preferably either a separate part that is assembled with an inner soleplate 20 (as shown) or optionally an exposed portion of the inner soleplate 20 as described further below.

The steam generation chamber 54 can be integral with or thermally connected to the soleplate assembly 18. According to various embodiments, the outer soleplate 38 of the soleplate assembly 18 and the steam generating chamber 54 are each configured to operate at different temperatures allowing steam to be generated while also allowing the outer soleplate 38 to function at lower temperatures, such as needed for delicate fabrics. More water can be injected into the soleplate assembly 18 in order to control relative temperatures in various portions of the soleplate assembly 18. For example, injecting more water into the steam generating chamber 54 may reduce a temperature of the inner soleplate 20 while having less effect on the outer soleplate 38, or vice-versa. Heat transfer to the outer soleplate 38 comes from the steam and all conductive connections.

A benefit of the design of the soleplate assembly 18 in accordance with the present invention, as described herein, the preferred construction avoids undesirable dripping of unboiled (liquid phase) water when the iron is in a horizontal position, a vertical position, or various angled positions. Therefore, disclosed is an iron 10 with the steam generating chamber 54 design for fabric steaming, where the chamber 54 has fluid channeling and guiding features provided by guide elements 30 to fully convert liquid water to steam and to thus prevent liquid water from dripping in multiple orientations while providing a large outer soleplate 38 for ironing. The steam generation chamber 54 at least partially defines the fluid flow path 106 with a number of guide elements 30. The guide elements 30 can include multiple rings of barriers, such as an inner barrier (or set of barriers), an intermediate barrier (or set of barriers), and an outer barrier (or set of barriers). Any number of barriers are contemplated herein. As shown, the various rings of barriers can be generally concentric and can be non-continuous in certain selected areas.

The steam generation chamber 54 is preferably closely positioned to the heating element 78 that is preferably integrated into the inner soleplate 20 of the soleplate assembly 18. The steam generation surface 55 is therefore preferably directly adjacent to the internal heating element 78. Moreover, the position of the heating element 78 within the inner soleplate 20 can define a central hot zone 81 of the steam generation surface 55.

As shown, the heating element 78 is generally shaped as a modified U or W such that an additional bend allows for more even heating of the conductively heated inner soleplate 20. The guide elements 30 and the fluid flow path 106 are preferably configured to accomplish both a longer flow path from a water inlet 46 of the steam generation chamber 54 to the exit of the steam generation chamber (openings 102), and maximizing the heat conductivity to the areas of the defined fluid flow path to more efficiently and quickly boil water that passes through the path 106. The guide elements 30 are preferably configured to cause the path or paths 106 to cross the heating element 78 at least once. As shown, the steam flow paths 106 are defined by the plural guide elements 30, with each steam flow path 106 starting from the central hot zone 81 and travelling similarly in crossing various portions of the heating element 78. In various embodiments, the flow path 106 crosses the heating element 78 at least at one point between the central hot zone 81 and the tip front portion 14 and at least at one point along the at least one portion of the heating element 78 that extends along the rear base portion 16. In further embodiments, plural steam flow paths 106 are defined by the plural guide elements 30, each steam flow path 106 starting from the hot zone 81 and travelling similarly in crossing the heating element 78.

Various passages are also preferably shaped and sized in accordance with standard practices in the art for minimizing calcification build-up within the steam generation chamber 54, among other heated parts of the iron 10. After the water has passed from the steam generation chamber 54 to the steam distribution chamber 56 via first openings 102 in outer barrier 36 into post-barrier external cavity and a peripheral channel 104, the heated water and/or steam eventually passes through passages 88 that flow into the distribution chamber 56. The peripheral channel 104 preferably acts as an intermediate space between the steam generation chamber 54 and the steam distribution chamber 56 and is bounded at the outside by a soleplate outer wall 28. Outlet passages 88 of the peripheral channel 104 provide fluidic communication from the steam generating chamber 54 to the steam delivery chamber 56 by way of the peripheral channel 104 that at least partially surrounds the steam generating chamber 54, and in particular the outermost barrier (e.g., barrier 36) of the guide elements 30. Preferably the heated water and/or steam that reaches the distribution chamber 56 is substantially all in the steam phase.

In preferable embodiments, the heating element 78 is integrated into the inner soleplate 20 and has a shape as selected by various thermal properties and desired evenness of thermal heat produced by the heating element 78. Preferably and as shown, the heating element 78 has two operative connections 80 proximate the tip portion 14 of the soleplate assembly 18. The heating element 78 in combination with the inner soleplate 20 and the soleplate assembly 18 is used to boil water and at least conductively heat the outer soleplate 38. Different arrangements of the heating element 78 would lead to different thermal heating and characteristics of heating and ironing, although various thermal conductive connections can be adapted to more evenly heat the inner soleplate 20 and outer soleplate 38 for a given heating element 78 shape and configuration. In alternative embodiments the heating element 78 can take any suitable shape and can be fully removable from the inner soleplate 20. In preferable embodiments, the heating element 78 is shaped along the inner soleplate 20 for heating the inner soleplate 20 from one power connection point 80 to a second power connection point 80. As described herein, both power connections points 80 are preferable positioned near the pointed tip front portion 14 of the soleplate assembly 18. Based on the positioning of the connection points 80, a relatively cooler zone of the soleplate assembly 18 would be located at or near tip portion 14. Likewise, relatively hotter zones, such as central hot zone 81, would be located closer to the base portion 16.

The heating element 78 preferably includes an intermediate portion 79 (see FIG. 14) located along a length between the first and second power connections 80, and is arranged to extend from the first power connection point 80 toward the rear base portion 16 and then back toward to the tip front portion 14, then back toward the rear base portion 16 and then to the second power connection point 80, including the at least one portion that extends at least partially along the rear base portion 16. Other arrangements of the heating element 78 are also contemplated herein.

Also included within the housing 12 is the thermostat 100 that contacts at least a portion of the soleplate assembly 18 at a raised thermal contact pad 26 of the inner soleplate 20. The thermostat 100 is operatively coupled to the controller (not shown) such that the working temperature of the inner soleplate 20 is actively and accurately monitored during use. The thermostat 100 preferably passes through opening 48 in the cover 42, and directly contacts the inner soleplate 20 at or near the central hot zone 81 of the inner soleplate 20 such that the operative boiling temperatures are monitored based on temperatures at or near the central hot zone 81 of the steam generating surface 55. In alternative embodiments, the thermostat 100 can be located at any suitable location within the housing 12 and can contact any part of the soleplate assembly 18 directly or indirectly. In yet further embodiments, the thermostat 100 can be a contactless thermostat that operates without directly touching any part of the soleplate assembly 18.

Figure 11:
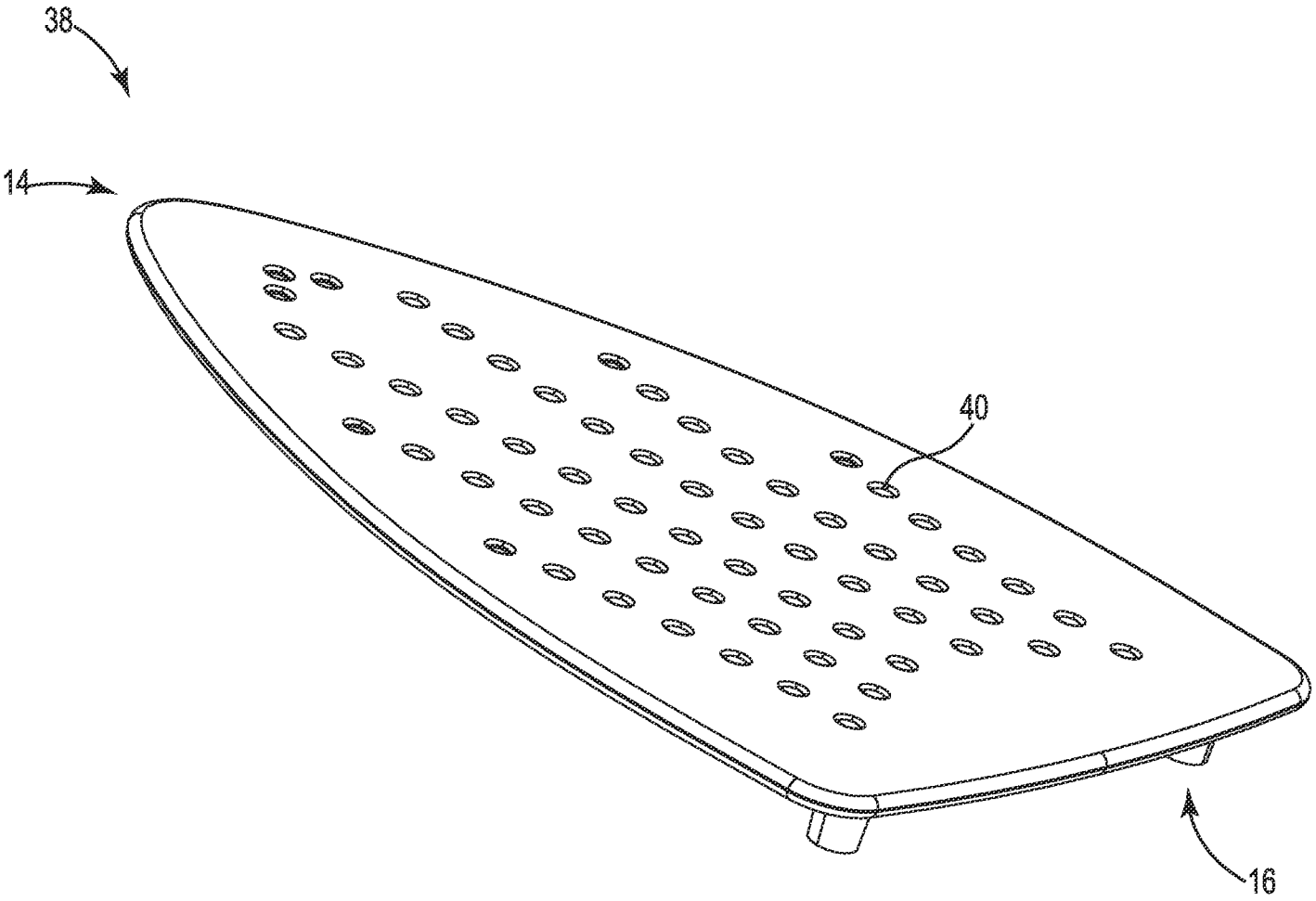
FIG. 11 is a lower perspective view of an outer soleplate of the soleplate assembly of FIG. 10, according to various embodiments.
Figure 12:
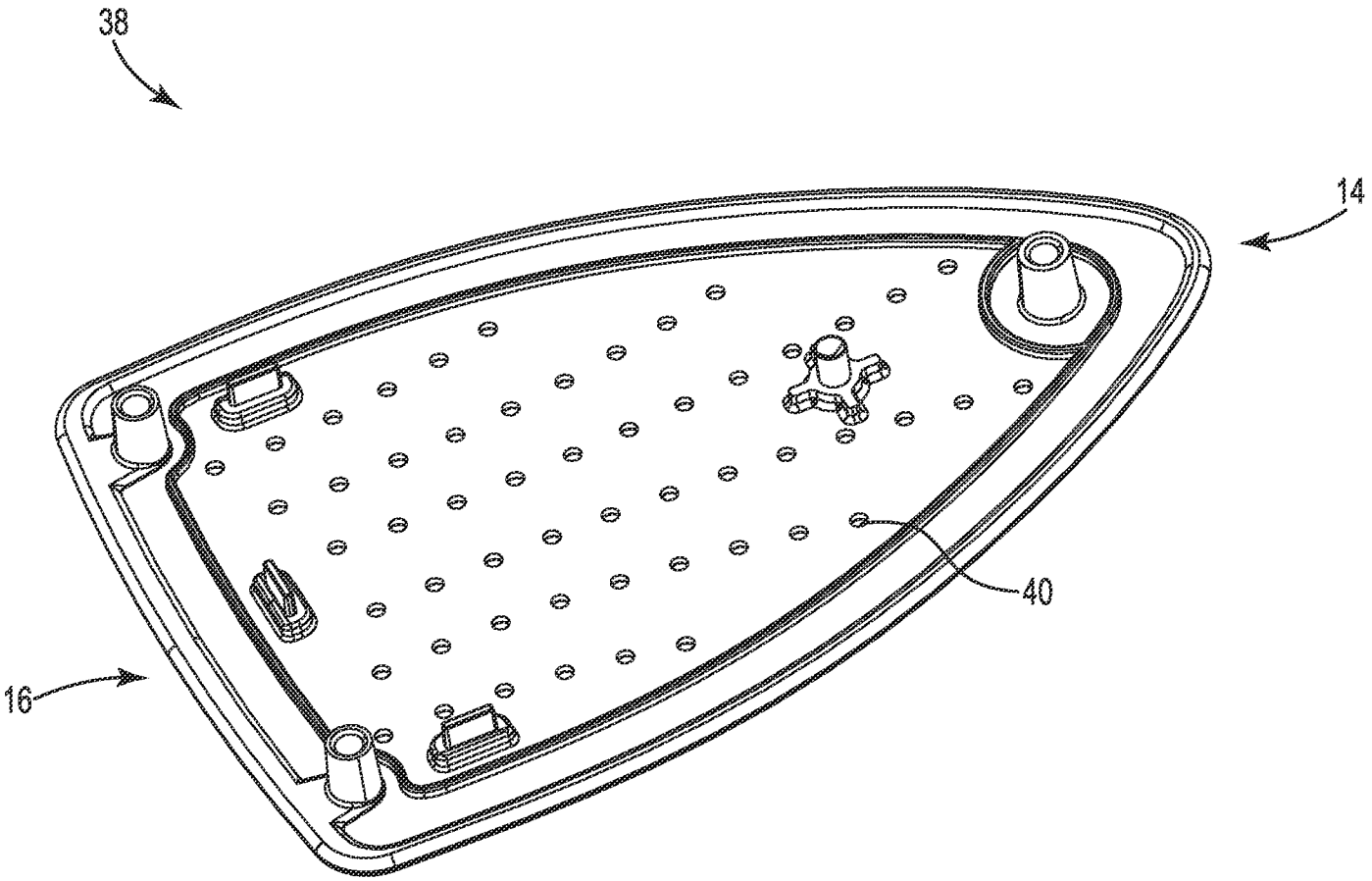
FIG. 12 is an upper perspective view of the outer soleplate of FIG. 11, according to various embodiments.

With reference to FIGS. 11 and 12, the outer soleplate 38 is the primary operative component of an iron that contacts fabric to be ironed. The outer soleplate 38 is generally not heated beyond a certain point at which various fabrics burn, melt, etc. Various control systems can receive a heat setting and permit the soleplate to reach a certain temperature range, e.g., based on the type or delicateness of fabric to be ironed. Simply heating the soleplate can provide enough residual heat to permit ironing without additional added heat for a time.

Also according to various embodiments, a multi-path, or bifurcated circuitous heated fluid flow path 106 channels steam along the steam generation surface 55 of the steam generating chamber 54. The multi-path fluid flow path 106 can flow along, near, or within the air gap between the inner soleplate 20 and the outer soleplate 38. It is contemplated that some thermal transfer can occur via convection and/or via water/steam within the air gap. The fluid flow path 106 as shown is preferably circuitous or labyrinthine in nature as the fluid passes from an opening 46 that facilitates the water outlet of the pump 74 to communicate with the steam generating chamber 54, to eventually arrive in the lower cavity 56 before the fluid reaches the fabric for ironing through holes 40. Openings 102 in the guide elements 30 of the inner soleplate 20 are preferably proximate to the tip 14 and preferable between the tip 14 and the central hot zone 81 of the soleplate assembly 18 so as to further reduce water leakage when liquid water has not been fully changed to steam.

Figure 13:
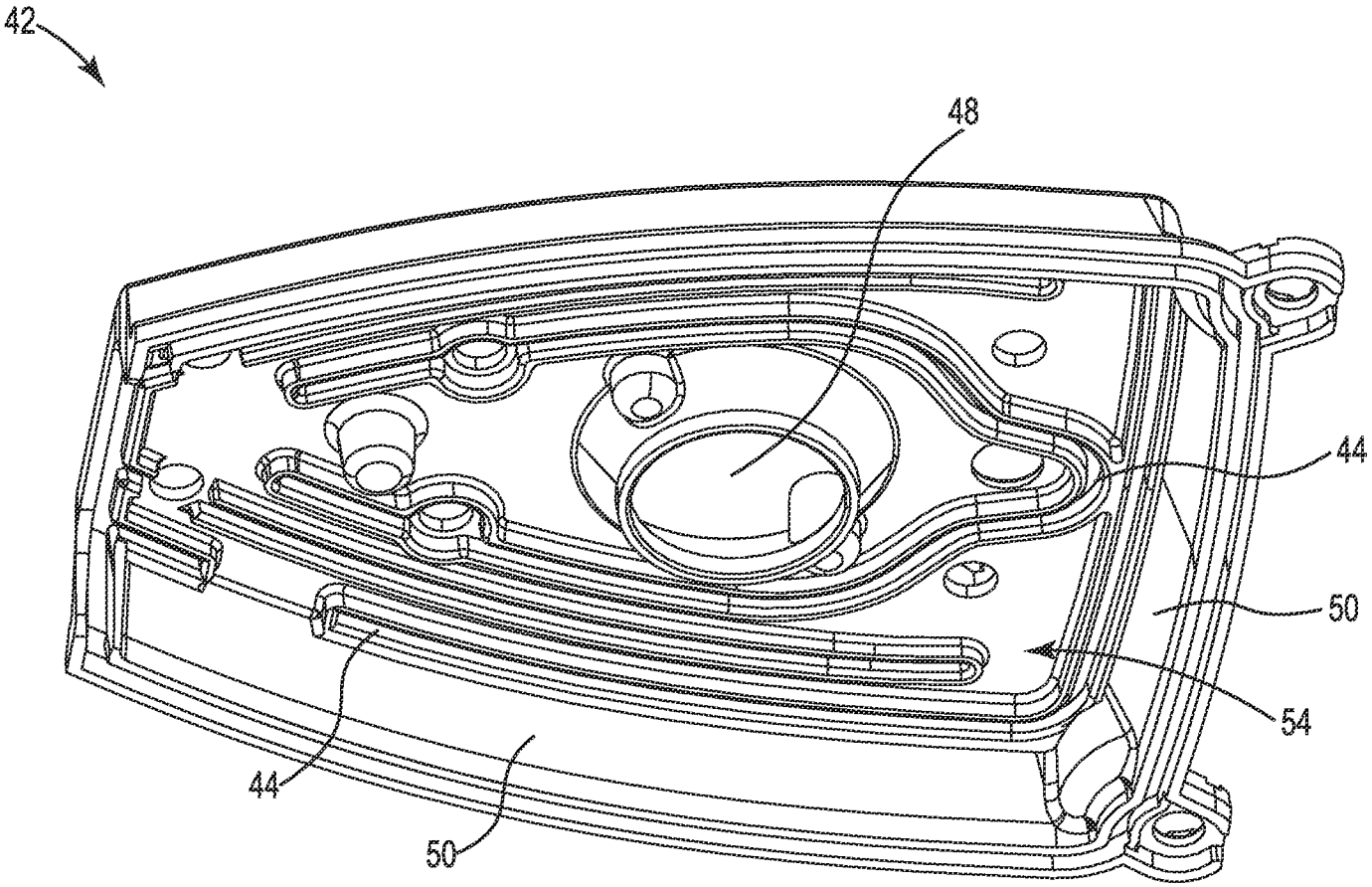
FIG. 13 is a lower perspective view of a soleplate cover of the soleplate assembly of FIG. 10, according to various embodiments.

With reference now to FIG. 13, and in preferable embodiments, the circuitous fluid flow path 106 has multiple "back and forth" direction changes. The Direction changes of the fluid flow path 106 are defined by the guide elements 30 of the inner soleplate 20 and also by the soleplate cover 42 grooves 44 that preferably interface with and seal to the guide elements 30 at an upper portion of the fluid flow passages 106. For example a sealant such as room temperature vulcanizing (RTV) silicone can be applied to the cover 42 and/or inner soleplate 20 prior to joining the two parts to effect a secure seal within the chamber 54. As shown with reference to FIG. 13, the cover 42 preferably comprises one or more grooves 44 shaped and positioned so as to receive upper extremities of guide element 30 to complete the fluid flow path 106. The water output tube 98 preferably runs from the pump 74 to deliver water to the steam generation chamber 54 via opening 46, and the cover 42 provides a sealed upper barrier to form part of the fluid flow path 106, which guides fluid within the steam generation chamber 54 of the soleplate assembly 18.

Figure 14:
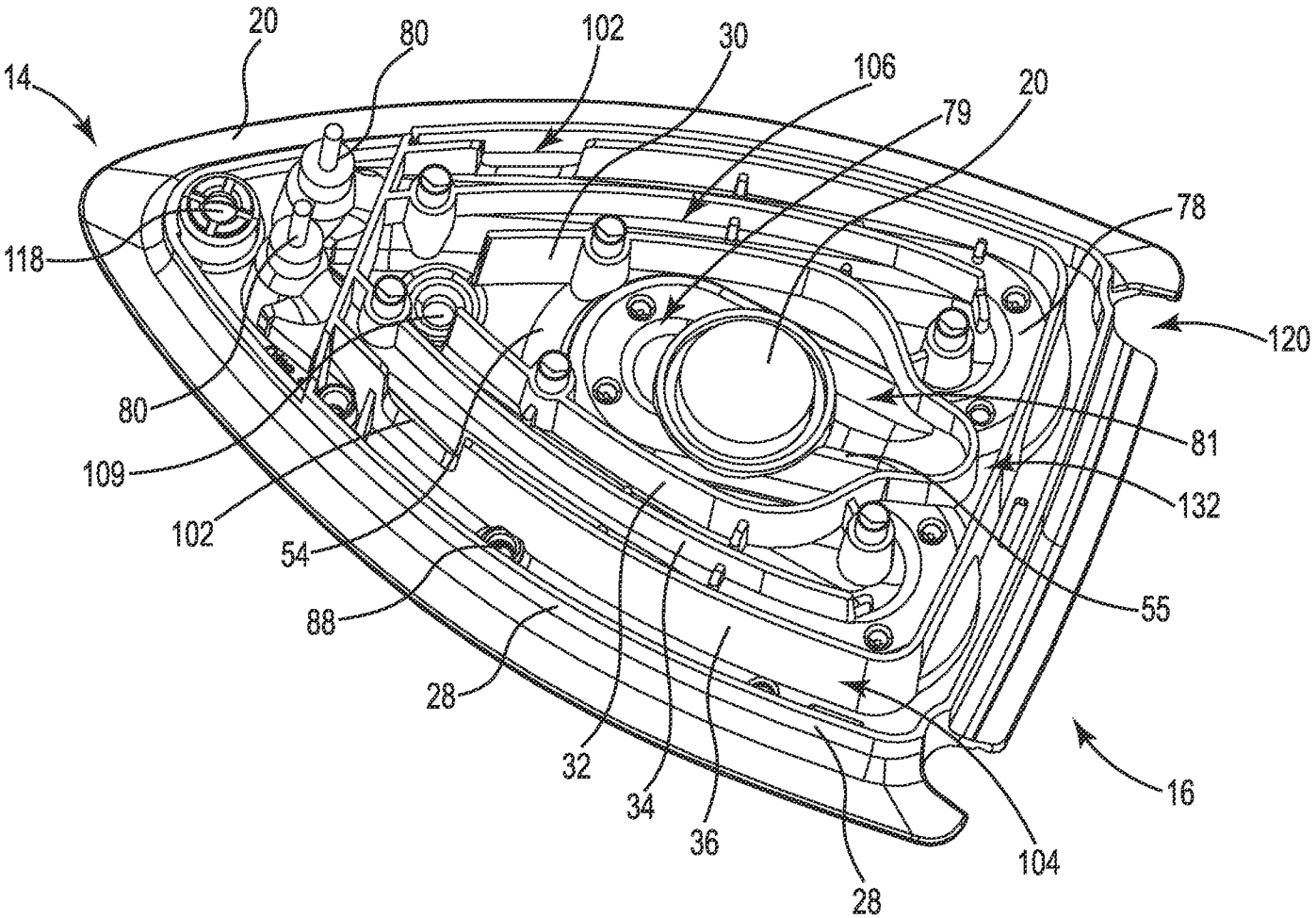
FIG. 14 is an upper perspective view of an inner soleplate of the soleplate assembly of FIG. 10, according to various embodiments.
Figure 15:
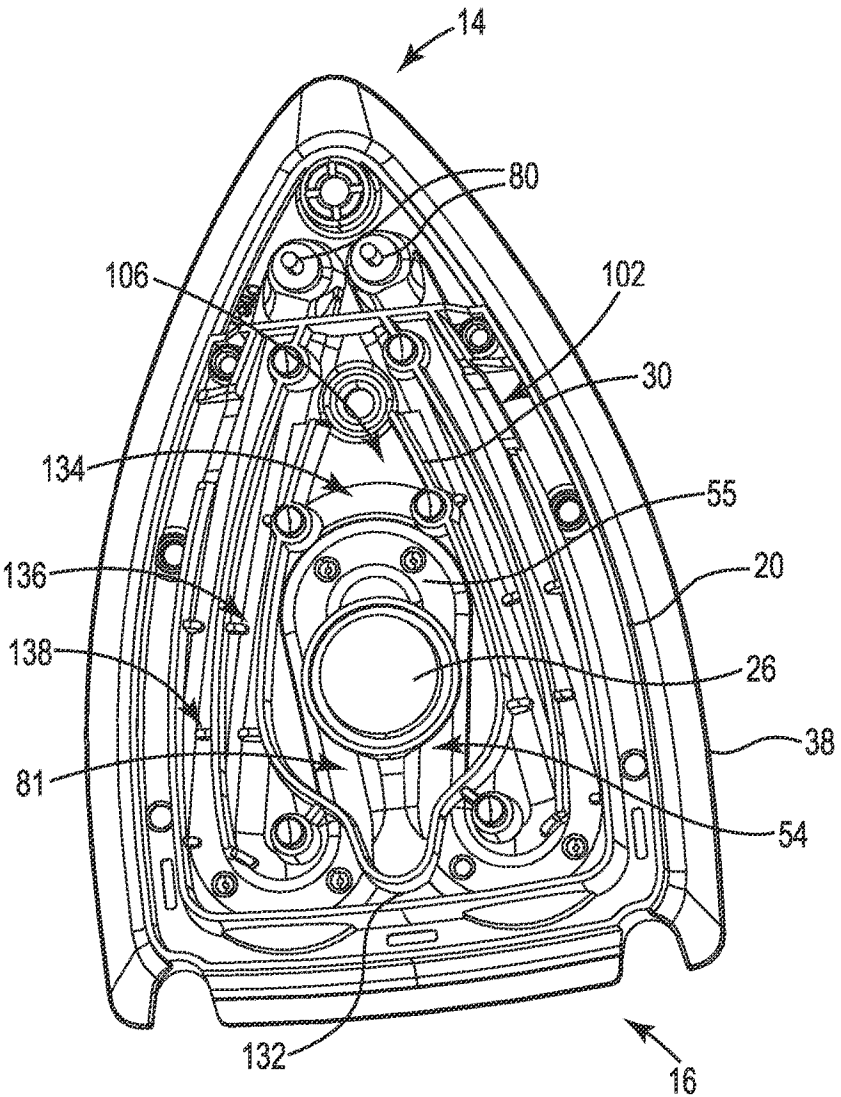
FIG. 15 is another upper perspective view of the inner soleplate of the soleplate assembly of FIG. 10, according to various embodiments.
Figure 16:
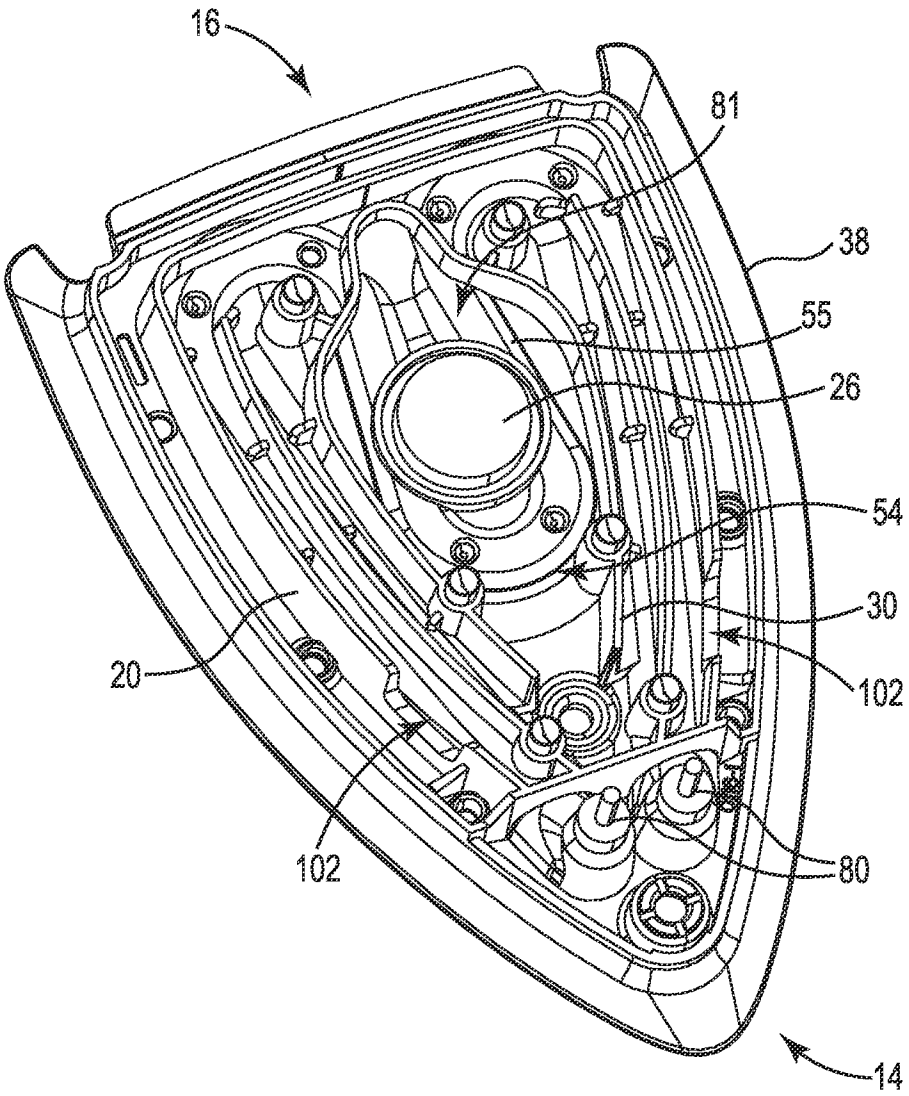
FIG. 16 is yet another upper perspective view of the inner soleplate of the soleplate assembly of FIG. 10, according to various embodiments.

As shown in FIGS. 14-16, the fluid flow path 106 can have two branches, one per side of the soleplate assembly 18 and iron 10. In some embodiments, the two branches can at least partially crossover at a point 132 (see FIG. 14) located near a path end within the inner soleplate 20 in order to at least partially equalize steam pressure and flow before passing out of the inner soleplate 20 and into the steam distribution chamber 56.

As discussed above, the guide elements 30 of the inner soleplate 20 are configured to define the fluid flow path 106 that diverts and lengthens, e.g., maximizes, the fluid flow path 106 as water is heated to steam are preferably configured jointly with the heating element 78 itself. Therefore, the guide elements 30 in combination with a position of opening 46 and openings 102 in outer barrier 38 create and maximize a time and distance of the fluid flow in order to create steam from water quickly and completely. The plural guide elements 30 preferably extend from the steam generation surface 55 to the cover 42 for defining at least one steam flow path 106 from the central hot zone 81, the flow path 106 crossing the heating element 78 at least at one point between the central hot zone 81 and the tip front portion 14 and at least at one point along the at least one portion of the heating element 78 that extends along the rear base portion 16.

For example, three distances of fluid flow proximate various portions of the heating element 78 would heat and steam water more quickly than a similar configuration with only one or two equivalent distances passing along the heating element 78 and defined by the guide elements 30. In various embodiments, and as shown in particular in FIG. 15, the plural guide elements 30 of each steam flow path 106 create a first steam flow path 134 portion extending from the central hot zone 81 toward the tip front portion 14 followed by a second steam flow path portion 136 extending rearward from the first steam flow path portion 134 followed by a third steam flow path portion 138 extending toward the tip front portion to the outlets. In other words, multiple steam flow path portions can provide a back-and-forth fluid path 106 that improves steaming performance of iron 10.

Figure 17:
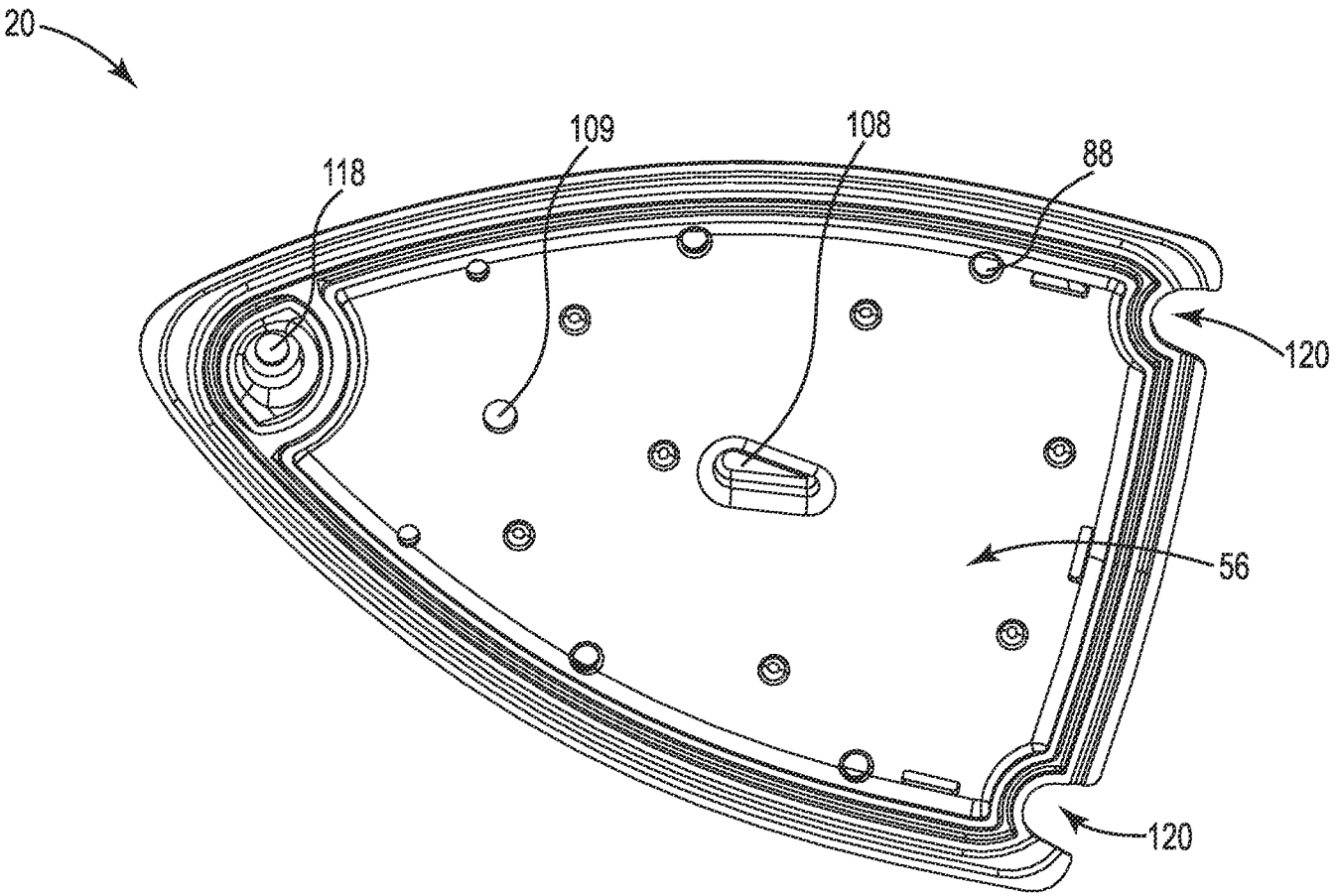
FIG. 17 is a lower perspective view of the inner soleplate of the soleplate assembly of FIG. 10, according to various embodiments.

Referring to FIG. 17, a central recess 108 of the inner soleplate 20 is shown from below. As shown in FIGS. 14 and 17, the inner soleplate 20 also includes an aperture 118 proximate the tip portion 14 for fastening to the inner soleplate 20 to the outer soleplate 38, the cover 42, and/or other components of the iron 10, a central attachment opening 109 in inner soleplate 20, and two attachment openings 120 in inner soleplate 20 near base portion 16 for fastening the inner soleplate 20 to other components of the iron 10. Other attachment configurations are also contemplated herein.

Figure 18:
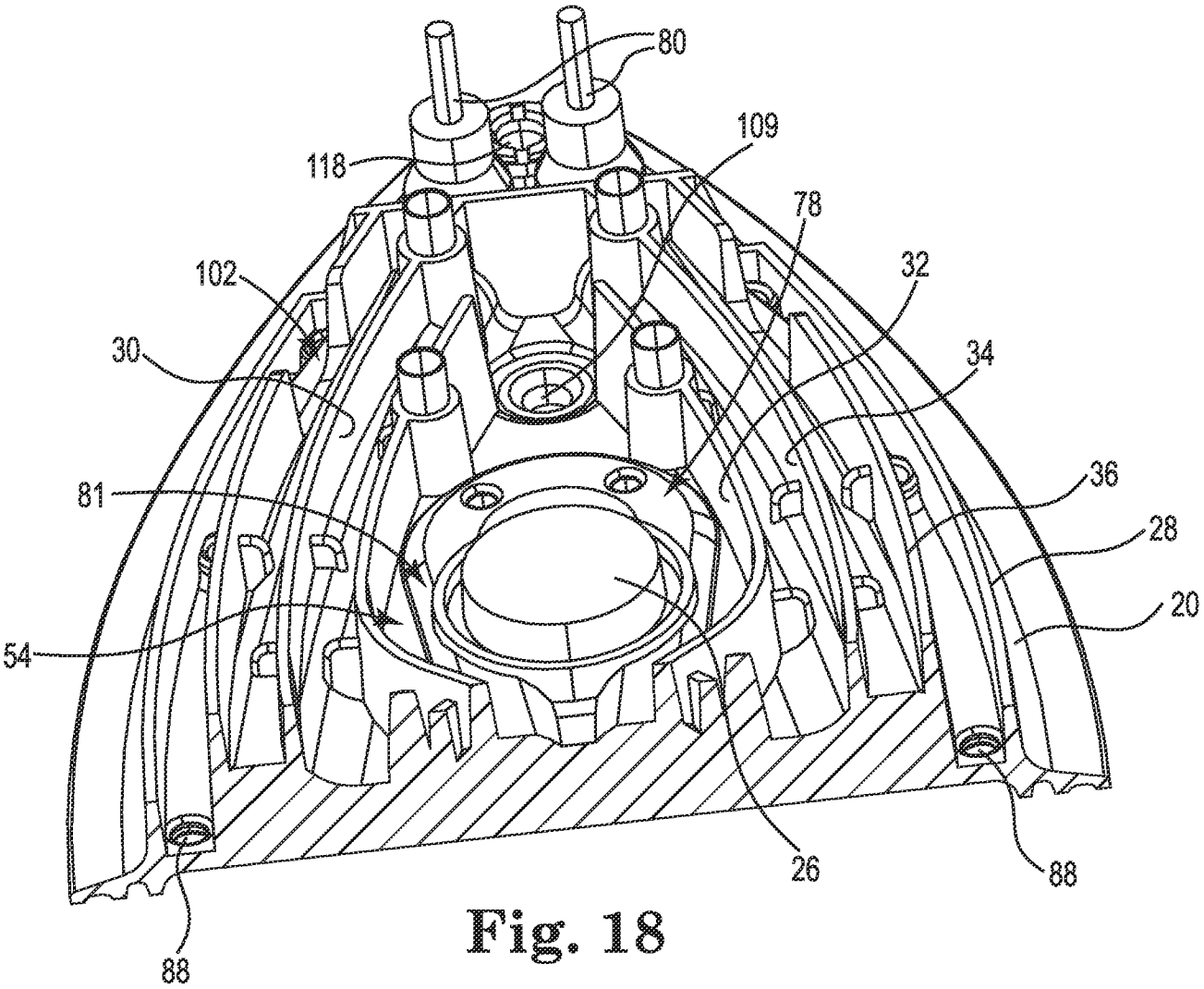
FIG. 18 is a transverse cross-sectional view of the inner soleplate of the soleplate assembly of FIG. 10, according to various embodiments.

With reference now to FIG. 18, the various barriers 32, 34, and 36 of the guide elements 30 are shown in a transverse cross-sectional view. The barriers 32, 34, and 36 preferably define the first, second, and third steam flow path portions 134, 136, and 138.

As shown in FIG. 19, the opening 46 and fluid inlet to the steam generation chamber 54 is preferably located rearward of thermal connection 26 for thermostat 100, and such that water received via opening 46 passes by the hot zone 81 of the steam generation surface 55 before passing out of the steam generation chamber 54.

The air gap of the steam distribution chamber 56 as shown provides for a spreading plenum and provides even steam distribution to various output holes 40 that guide steam to the fabric to be ironed. Therefore, the steam distribution chamber 56 can provide for a steam passage for use during a steam application using the iron 10. The distribution chamber 56 can be sized, shaped, or otherwise configured for thermal transfer properties between the inner soleplate 20 and the outer soleplate 38.

As discussed above, the air gap can provide a limited and controlled thermal transfer between the outer 38 and inner soleplates 20 and allowing the outer soleplate 38 to function at lower temperatures while having the central hot zone 81 of the inner soleplate 20 sufficiently hot to generate steam as water enters the steam generation chamber 54 via opening 46. The central hot zone 81 of the steam generation surface 55 is preferably positioned below the water outlet and opening 46. The air gap forms the steam distribution chamber 56.

Thermal transfer between the inner 20 and outer soleplates 38 is optionally enhanced by any thermally conductive connections, etc. The heating element 78 is preferably integral to the inner soleplate 20. In some embodiments, the inner soleplate 20 and outer soleplate 38 can have independently-controlled temperatures. In further embodiments the thermally conductive connection can be selected to permit a certain flow of heat from the inner soleplate 20 to the outer soleplate 38 or vice-versa. In yet further embodiments, the thermally-conductive connection can be controlled or selectively configurable during use, e.g., to achieve a desired outer soleplate 38 temperature without being directly correlated to the inner soleplate 20 temperature. Materials that connect the inner soleplate 20 and the outer soleplate 38 can be selected and/or configured such that certain thermal transfer properties or rates are achieved between the inner soleplate and the outer soleplate 38. Certain parts of the outer soleplate 38 can receive more or less thermal energy from the heating element 78 and inner soleplate 20, and the thermally conductive paths can be adjusted in order to more evenly distribute heat to various parts of the outer soleplate.

In addition, the higher-temperature inner soleplate 20, particularly the central hot zone 81 of the steam generation surface 55, can facilitate the immediate production of steam for use during ironing and/or steaming. By having a hot inner soleplate 20 within the iron, heat from the heating element 78 can be stored and steam can be produced more readily and for longer durations. Embodiments disclose using lower temperature outer soleplate 38 while allowing a higher steam rate due to higher temperature inner soleplate 20 in order to effectively remove wrinkles without burning fabric. The disclosed iron 10 can produce more steam for a given amount of time as compared to an iron without the inner soleplate 20 having integrated heating element 78 and fluid guiding passages and guide elements 30.

Figure 20:
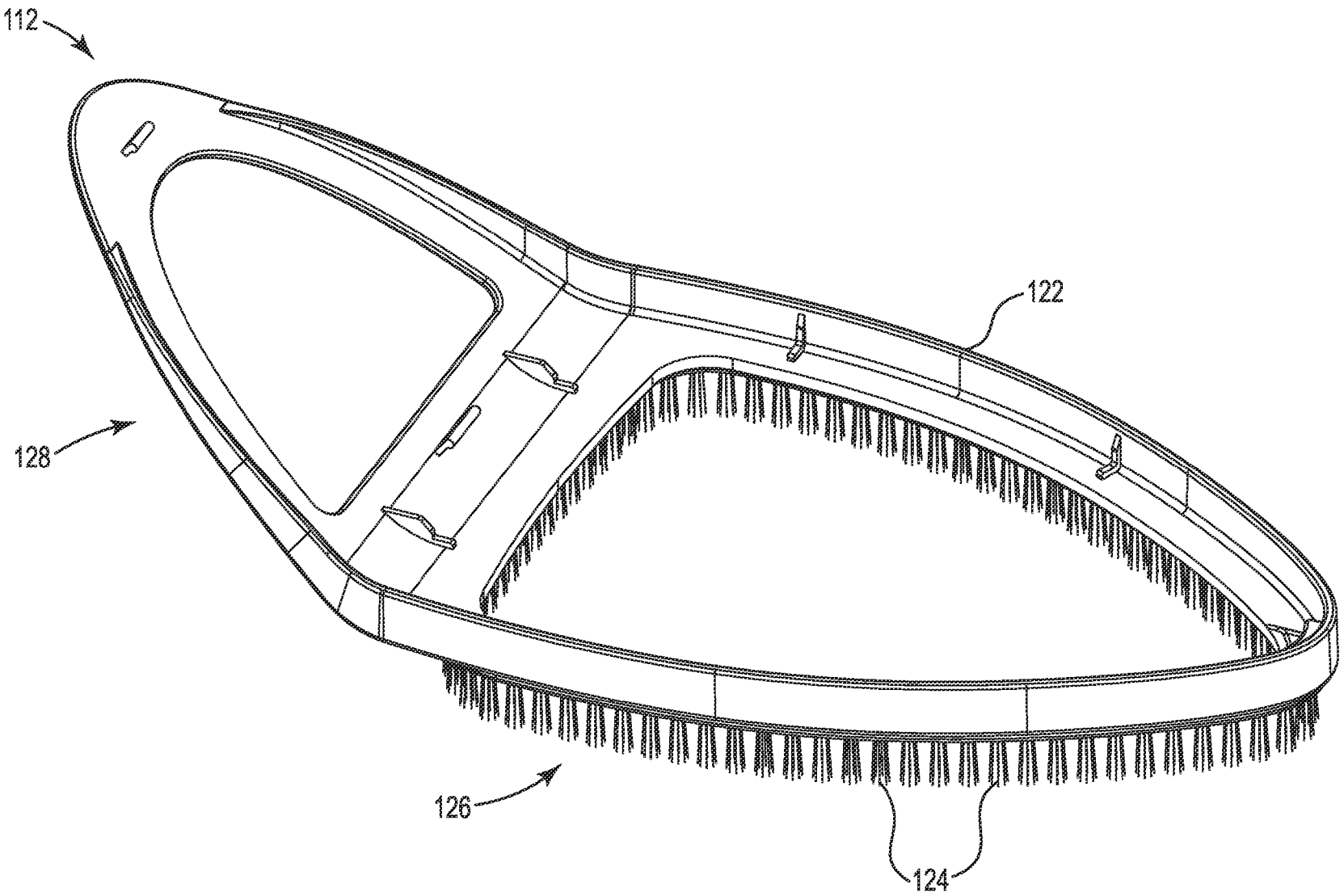
FIG. 20 is a top perspective view of an attachment for use with the iron of FIG. 1, according to various embodiments.
Figure 21:
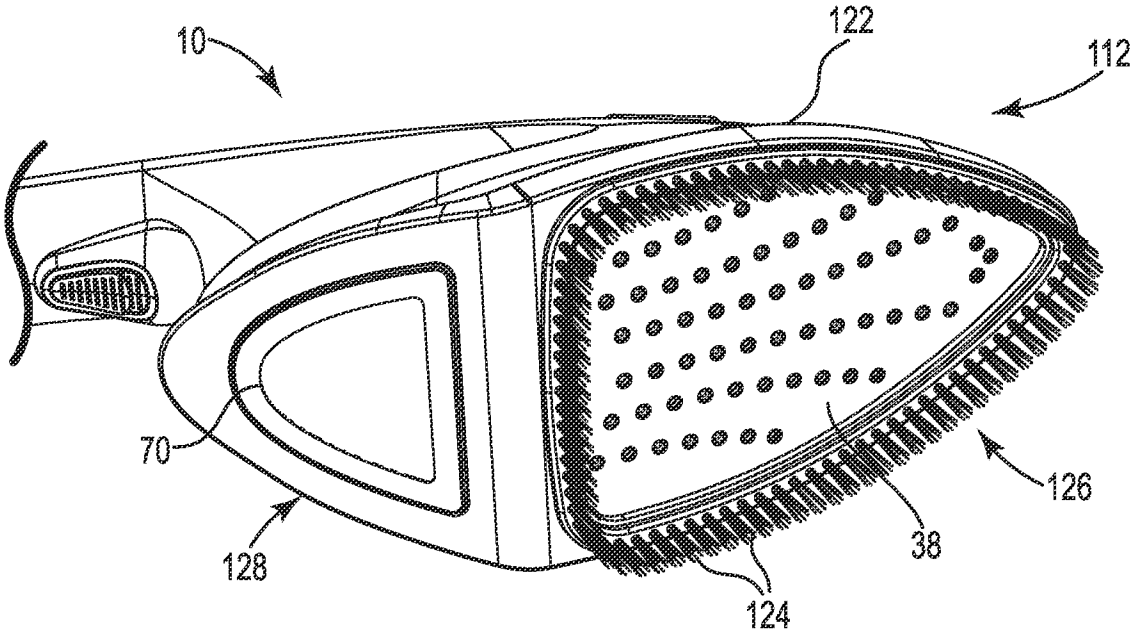
FIG. 21 is a bottom perspective view of the attachment of FIG. 20 as mounted to the iron of FIG. 1, according to various embodiments.

Turning now to FIGS. 20 and 21, an optional attachment 112 for use with iron 10 is shown. Attachment 112 is a removable, preferably held to iron 10 by one or more snap-fit complementary features on the iron 10 and the attachment 112, itself. The attachment 112 is shown removed from the iron 10 in FIG. 20, and attached to the iron in FIG. 21. The attachment 112 includes a peripheral rim 122 with a soleplate portion 126 and a rest plate portion 128 as shaped and sized to conform and contour to the outer soleplate 38 and rest plate 70, respectively. Attached at one or more locations around the peripheral rim 122 and facing downward are a plurality of brush features such as bristles 124. The bristles 124 are preferably configured to interface with a fabric being ironed or steamed so as to improve ironing, steaming, and/or cleaning performance of the iron 10 when used with the attachment 112.

In optional embodiments, the soleplate assembly 18 described herein comprises only a single soleplate unit that substantially combines at least some of the functions of the inner 20 and outer soleplates 38, described herein. In selected optional embodiments, a lower portion of the single soleplate (e.g., based on the inner soleplate 20) would be configured to directly contact or face fabrics to be ironed and/or steamed without including a separate, outer soleplate 38. Therefore, and as described herein, the inner soleplate 20 and outer soleplate 38 can be understood to be either separate components comprised within the soleplate assembly 18, various parts of a single unit of the soleplate assembly 18, or any combination or variation thereof in accordance with the present disclosure. In yet further embodiments, a variation is contemplated where the inner soleplate 20 is configured to directly contact or face a fabric to be ironed and/or steamed without including the outer soleplate 38 and one or more parts or functions thereof. In these embodiments, a lower part of the inner soleplate 20 would lack the steam distribution chamber 56 and the outlet passages 88 would become steam delivery openings 40 for directly providing steam to the fabric to be ironed and/or steamed.

As shown in the described embodiments, the heat source is contained within the iron itself. In other embodiments, electricity can be converted to thermal energy using a heat source within a stationary base, within the iron itself, or both. In some embodiments the heat source is a resistive heater, such as a Calrod or quartz-type heating element. In yet other embodiments, the heat source is a resistive heater that heats the soleplate assembly, having disconnectable electrical connections to the stationary base. An electrical or thermal connection can transfer energy in the form of heat and/or electricity from the base to the removable iron.

What is claimed is:

1. A hand-held steam iron comprising:

a housing including a handle portion for manipulation of the hand-held steam iron, the housing also including a water reservoir that is accessible from outside the housing for filling and that is fluidically connected with a pump for delivering water to a steam generating chamber from a water outlet, the housing also including an electrical power connection for providing power to a power circuit including an electrical connection with the pump as controlled by a trigger provided for user manipulation at an external position of the housing so that when the trigger is activated, water will be pumped from the water reservoir to the steam generating chamber; and a soleplate assembly operatively connected with the housing, the soleplate assembly comprising an inner soleplate and a cover, the inner soleplate including a steam generation surface and a heating element below the steam generation surface that is also connected with the power circuit for heating the inner soleplate and thus the steam generation surface, the cover being connected with the inner soleplate to enclose the steam generation surface for creating the steam generating chamber, the cover including an opening that facilitates the water outlet to communicate with the steam generating chamber, wherein the inner soleplate is shaped to have a pointed tip portion and a rear base portion, and wherein the steam generation surface further comprises plural guide elements that extend from the steam generation surface to the cover for defining at least one steam flow path from a hot zone located under the water outlet, the flow path crossing the heating element at least at one point between the hot zone and the tip front portion and at least at one point along at least one portion of the heating element that extends along the rear base portion.

2. The hand-held steam iron of claim 1, wherein the soleplate assembly further comprises an outer soleplate spaced from the inner soleplate on the opposite side as the steam generation surface, wherein the inner soleplate includes at least one opening for allowing steam to travel from the steam generating chamber to a steam delivery chamber that is formed between the inner and outer soleplates, the outer soleplate further comprising at least one steam delivery opening for discharging steam from the hand-held steam iron upon activation of the trigger.

3. The hand-held steam iron of claim 2, wherein plural steam flow paths are defined by the plural guide elements, each steam flow path starting from the hot zone and travelling similarly in crossing the heating element.

4. The hand-held steam iron of claim 3, wherein outlets are provided from the steam flow path between the tip front portion and the hot zone, which outlets fluidically communicate with the steam delivery chamber.

5. The hand-held steam iron of claim 4, wherein the plural guides of each steam flow path create a first steam flow path portion extending from the hot zone toward the tip front portion followed by a second steam flow path portion extending rearward from the first steam flow path portion followed by a third steam flow path portion extending toward the tip front portion to the outlets.

6. The hand-held steam iron of claim 5, wherein the outlets provide fluidic communication from the steam generating chamber to the steam delivery chamber by way of peripheral channel that at least partially surrounds the steam generating chamber.

7. The hand-held steam iron of claim 1, wherein the heating element is connected with the power circuit near the pointed tip front portion.

8. The hand-held steam iron of claim 7, wherein the heating element is shaped along the inner soleplate for heating the inner soleplate from one power connection point to a second power connection point, wherein both power connection points are located near the tip front portion.

9. The hand-held steam iron of claim 8, wherein an intermediate portion of the heating element between the first and second power connections is arranged to extend from the first power connection point toward the rear base portion and then back toward to the tip front portion, then back toward the rear base portion and then to the second power connection point, including the at least one portion that extends at least partially along the rear base portion.

10. The hand-held steam iron of claim 9, wherein the heating element creates the hot zone of the steam generation surface that is positioned below the water outlet as a result of the shape of the heating element at a central portion of the inner soleplate.

11. The hand-held steam iron of claim 10, wherein the hot zone is a central hot zone.

* * * * *